US010526104B2

(12) United States Patent
Turci

(10) Patent No.: US 10,526,104 B2
(45) Date of Patent: Jan. 7, 2020

(54) APPARATUS FOR APPLYING LABELS ON PRODUCTS

(71) Applicant: Bizerba SE & CO. KG, Balingen (DE)

(72) Inventor: Davide Turci, Cesena (IT)

(73) Assignee: BIZERBA SE & CO. KG, Balingen (DE)

( * ) Notice: Subject to any disclaimer, the term of this patent is extended or adjusted under 35 U.S.C. 154(b) by 876 days.

(21) Appl. No.: 15/112,202

(22) PCT Filed: Jul. 9, 2014

(86) PCT No.: PCT/IB2014/062972
§ 371 (c)(1),
(2) Date: Jul. 18, 2016

(87) PCT Pub. No.: WO2015/004615
PCT Pub. Date: Jan. 15, 2015

(65) Prior Publication Data

US 2017/0036801 A1 Feb. 9, 2017

(30) Foreign Application Priority Data

Jul. 10, 2013 (IT) ..... BO2013A0359

(51) Int. Cl.

| | |
|---|---|
| ***B65C 9/18*** | (2006.01) |
| ***B65C 9/36*** | (2006.01) |
| ***B65C 9/40*** | (2006.01) |
| ***B65C 9/28*** | (2006.01) |

(52) U.S. Cl.
CPC ..... *B65C 9/1876* (2013.01); *B65C 9/28* (2013.01); *B65C 9/36* (2013.01); *B65C 9/40* (2013.01)

(58) Field of Classification Search
CPC ..... B65C 9/40; B29C 9/42; B29C 9/401
See application file for complete search history.

(56) References Cited

U.S. PATENT DOCUMENTS

| | | | | |
|---|---|---|---|---|
| 2002/0189741 | A1 | 12/2002 | Nielsen et al. | |
| 2010/0101731 | A1 | 4/2010 | Sleiman et al. | |
| 2010/0119785 | A1* | 5/2010 | Hobson | B05C 5/027 428/195.1 |

FOREIGN PATENT DOCUMENTS

| | | | |
|---|---|---|---|
| EP | 1067360 | A1 | 1/2001 |
| WO | WO 2010067337 | A2 | 6/2010 |

* cited by examiner

*Primary Examiner* — Christopher T Schatz
(74) *Attorney, Agent, or Firm* — Leydig, Voit & Mayer, Ltd.

(57) ABSTRACT

An apparatus for processing, e.g., labelling, respective products, e.g., fruit and vegetables, contained in a suitable container, or crate, has a supporting framework, product feeder, and label applier having a plurality of label application devices provided or arranged side by side and/or arranged in a first and a second transversal row of devices. The apparatus may have an electronic processor for controlling the units of the apparatus, which, for each product, starting with the detected configuration of the respective batch, or crate of products, determine a product area, e.g., having a circular or oval shape, which is large enough to allow complete application of a corresponding label.

8 Claims, 19 Drawing Sheets

311
312
40
41
42
5
3
abc
411
412
413
414

APPARATUS FOR APPLYING LABELS ON PRODUCTS

CROSS-REFERENCE TO RELATED APPLICATIONS

This application is a U.S. national stage application under 35 U.S.C. § 371 of International Application No. PCT/IB2014/062972, filed on Jul. 9, 2014, and claims benefit to Italian Patent Application No. BO 2013 A000359, filed on Jul. 10, 2013. The International Application was published in English on Jan. 15, 2015, as WO 2015/004615 A1 under PCT Article 21(2).

FIELD

This invention relates to an apparatus for processing respective products, in particular for applying labels on the products.

BACKGROUND

There are prior art apparatuses for applying labels on respective fruit and vegetable products, preferably contained in a suitable container or crate, which comprise a supporting framework, product feed means, and means for applying the labels on the products, having a plurality of label application devices, which are provided, in particular arranged, side by side and are configured in a first and a second transversal row of devices. The prior art apparatuses also comprise respective electronic processing means for controlling said application devices, starting with data relating to the position of the fruit and vegetable products according to longitudinal and transversal coordinates, which are entered directly by the users of such apparatuses.

In these known apparatuses, there are problems relating to the correct positioning of the labels on the product. The label is not always positioned on a part of the product able to support said label. As a result, the label is partly positioned on the product, consequently there is a high risk of unwanted label detachment from the fruit or product, in other cases, the label is even directly positioned on the crate, that is to say, in a completely inappropriate position.

Another problem with prior art label application machines relates to label positioning in off-center positions on the fruit or vegetable product, with a resulting high risk of unwanted detachment of the label from it. This is due to the fact that the prior art application devices are fixed on the respective supporting frame and cannot reach an optimum position for label application on the respective fruit or product.

A further problem with prior art label application machines relates to the difficulty picking up the labels using prior art bellows carrousels, difficulties mainly caused by label positioning which is not always perfect, at the point of label pickup by the bellows of the respective label pickup and application carrousel, that is to say because of the excessively flat shape of the end surface for label pickup of the respective application bellows element.

Another problem of prior art label application machines relates to the excessive construction complexity and consequent high production costs. Moreover, in the sector the need is felt for label application machines with a high level of operating effectiveness and which are highly flexible, in particular compared with prior art label application machines.

SUMMARY

An aspect of the invention provides a apparatus for processing respective products in the form of fruit or vegetables, the products being grouped in corresponding batches, contained in a suitable container or crate, the apparatus comprising: an applicator, configured to apply one or more labels on the products, the products being supported on a feeder adapted for the products; an electronic processor configured to control at least the application devices; and a detector, configured to detect respective products, wherein the applicator includes a plurality of application devices configured to apply respective labels, arranged in a first transversal row and a second transversal row of devices, wherein each row includes one or more of the application devices, and wherein the electronic processor is configured to determine, for each product, a product area, including those having a circular or oval shape, large enough to allow complete application of a corresponding label.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the invention proposes a novel solution, alternative to the solutions known up to now and which can overcome one or more of the above mentioned disadvantages and/or meet one or more of the requirements mentioned in or inferable from the above. In an aspect of the invention, products processed by the apparatus are preferably foodstuffs, in particular in the form of respective fruit and vegetables. They are preferably divided into respective batches, or groups of products, contained in a respective crate or container.

Therefore, in an aspect of the invention, an apparatus is provided for processing respective products, in particular in the form of foodstuffs, especially in the form of fruit and vegetables, the products preferably being grouped in corresponding batches, preferably contained in a suitable container or crate; the apparatus comprising at least one unit, or means, for applying labels on the products, the products being supported on suitable means, in particular feed means for the products; the unit for applying labels comprising a plurality of application devices for applying respective labels, preferably arranged in a first and a second transversal row of devices, where each row comprises one or more of said application devices; the apparatus comprising electronic processing means for controlling the respective units of the apparatus, in particular for controlling the application devices; characterized in that said electronic processing means for each product determine a product area, in particular having a circular or oval shape, large enough to allow complete application of a corresponding labels. In this way, it is possible to identify the zones of the product which allow secure and complete application of the label, thereby avoiding any risk of label detachment from the respective product.

Figure 1:
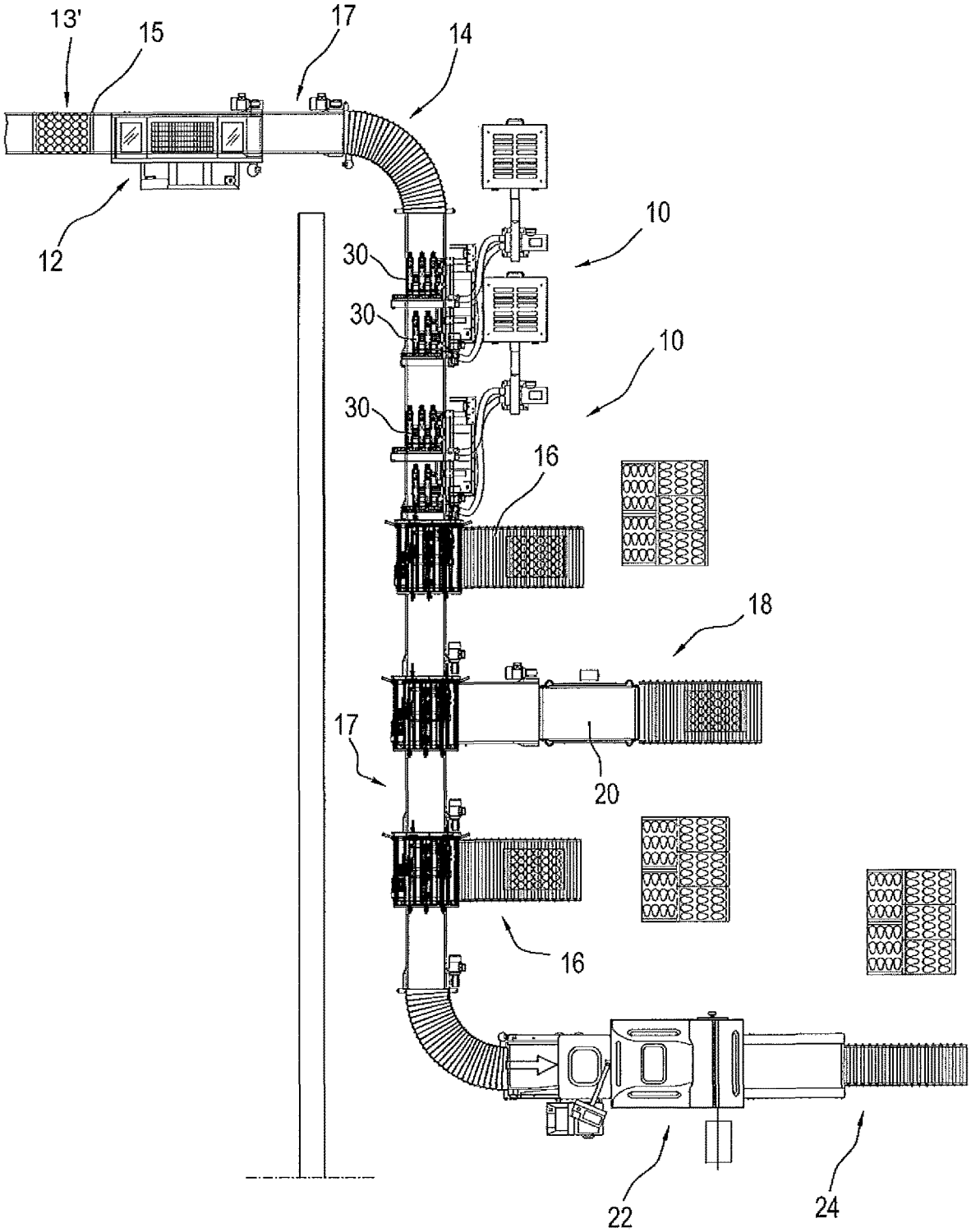
FIG. 1 is a top plan view of a preferred embodiment of an apparatus, or plant, for processing products, in particular for labelling fruit and vegetable products, according to this invention.

FIG. 1 shows a preferred plant, or apparatus, 11 for processing products, in particular in the form of foodstuffs, especially in the form of fruit and vegetables, in which a preferred embodiment 10, in particular a first and a second preferred embodiments of a unit for applying labels on respective products, in particular foodstuffs, such as fruit and vegetables are used.

The plant, or apparatus, and in particular the label application unit, processes products which are grouped in batches 13', corresponding to the content of a suitable container, or crate, 15. In particular, the crate, or container, 15 could container a shaped element comprising respective pits, or cavities, where a respective product is positioned, or it could be in the form of a non-pitted crate or container, in which the products are positioned as neatly as possible by operators.

The plant, or apparatus, comprises conveyor means, or belts, 17, which carry the products, or the crates of products, along a feed path, in which there are product detection or scanning means 12, in particular for a respective batch of products, or a respective crate containing said batch of products.

The plant, or apparatus, also comprises a temporary storage zone 14 for the corresponding products or batches of products, and a first and a second unit for applying labels 10, 10, as well as respective unloading stations 16, 16, in particular a first and a second unloading station, formed by respective roller conveyors, extending transversally to the main feed belt 17. Between the outfeed roller conveyors 16, 16 there is a further outfeed 18, where there is a check weigher 20 for weighing the batch, or crate, of products.

Finally, the numeral 22 denotes, in the apparatus, or plant, a machine for wrapping the crate or batch of products in a respective film, or for placing a corresponding film cover over the top of the crate, in such a way as to completely cover the product contained, and downstream of said wrapping machine there is a main outfeed 24 of the plant.

Figure 2:
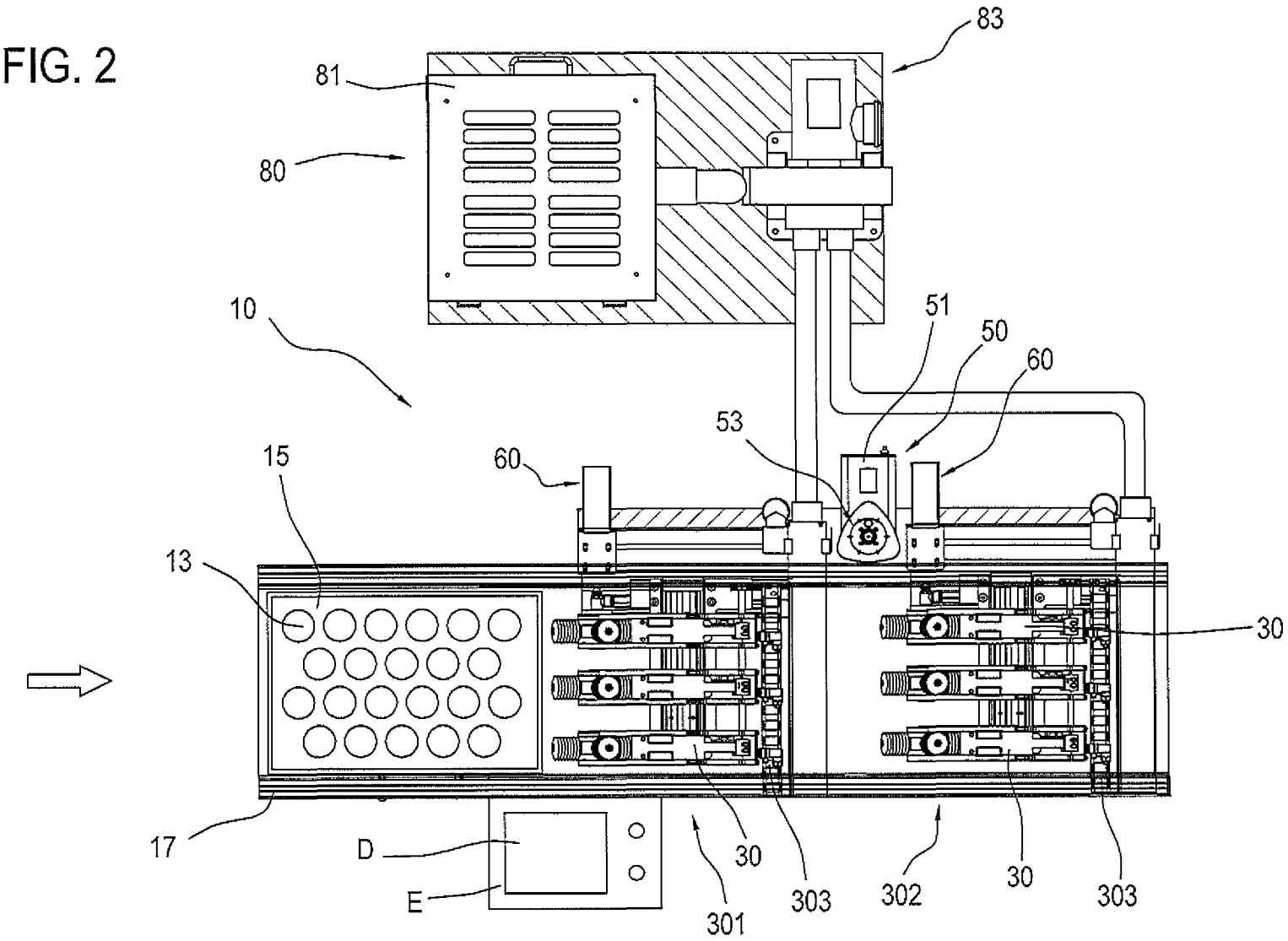
FIGS. 2, 3 and 4 are respective top plan, side and front views of a preferred embodiment of a unit for applying labels used in this apparatus.
Figure 4:
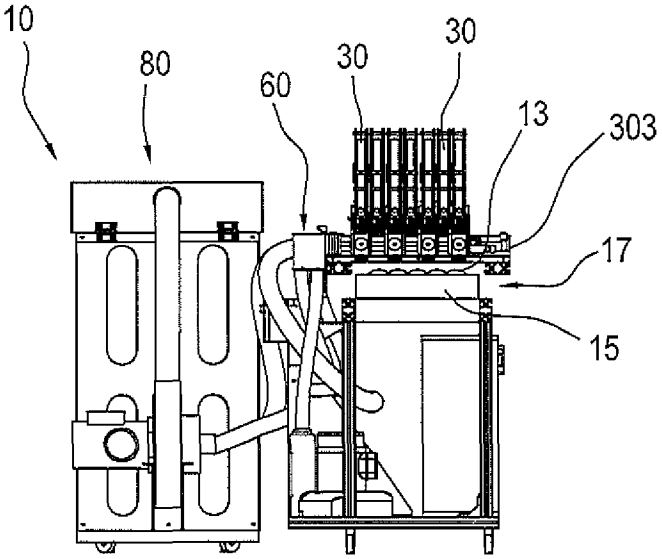
Figure 3:
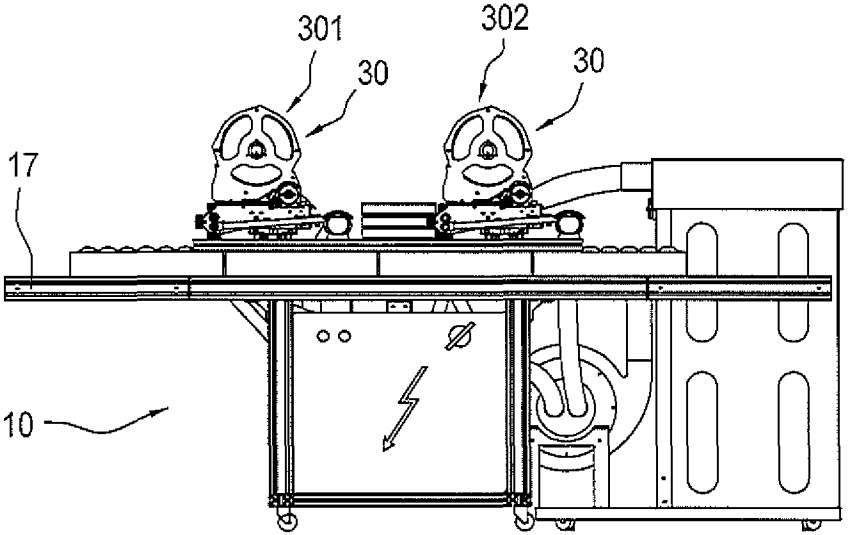

As can be better interred from the subsequent FIGS. 2 to 4, the label application unit 10 is designed to apply labels on said products 13 which are supported on suitable feed means 17 for the products 13 and comprises a plurality of application devices 30, which are positioned side by side and in a first and a second transversal row 301, 302 of devices 30. In particular, as illustrated, each row of label application devices 30 comprises a plurality of application devices. However, it shall be understood that each transversal row of application devices could comprise one or more of said application devices 30. In particular, there is a front row 301 of application devices 30 and a rear row 302 of application devices 30. In particular, the application devices of the first row operate on respective rows of products, which alternate with rows of products which are processed by the application devices 30 of the second row. In this way, it is possible to apply labels on products which are particularly close together and which could not be labelled using a single row of application devices 30.

Moreover, the apparatus comprises electronic control means provided with corresponding display means for interfacing with the operator.

These electronic processing means are illustrated in particular in FIG. 2, where they are labelled E. In particular, these electronic processing means are in the form of a PLC, provided with a respective touch screen, labelled D.

As illustrated, advantageously, the electronic processing means are preferably positioned at the side of the labelling unit 10.

However, it shall be understood that this processing apparatus could comprise only one label application unit, or means, 10, in particular operating on products whose configuration is preset in corresponding recipes, which are saved in the memory of the electronic control means E, as described in more detail below.

As can be interred from FIG. 1, upstream of the label application means there are means 12 for detecting the products or batches of product 13, said means being connected, in terms of data transmission, to the electronic processing means E of the apparatus, in particular designed to control the respective label application unit 10.

Detection of the products or respective batches of products by the detection means 12 allows the configuration of the products to be determined, in particular in the respective batch of products.

Therefore, the electronic processing means, controlled by a corresponding program, starting with the detected configuration of the products or the batch of products, determines, for each product 13, an area, in particular having a circular or oval shape, which is large enough to allow complete application of a corresponding label.

In use, said label application area, preferably circular or oval, is of a size such that it can accommodate the whole of a corresponding label.

In particular, according to a preferred embodiment, the electronic processing and control means E of this apparatus, starting with a reference surface of a preset size and suitable for accommodating a corresponding label, define on the respective product a respective application area, which is suitable for completely accommodating the respective label.

In this way, it is possible to prevent the corresponding labels from being applied in zones of the product which are not able to receive the complete label, that is to say, in zones of the products which have a geometric extension such that they do not completely support a corresponding label. In particular, for example, it avoids application of a label at the elongate end of the respective fruit or vegetable product, such as that illustrated in FIGS. 6 and 7.

In practice, the detection means 12 send corresponding data to the electronic processing means, which, starting with that data, determine the configuration of the products, in particular of the respective batch, that is to say, the position and shape of the products 13 and the position and shape of the container, or crate 15.

The configuration of the products or batch of products is, in particular, determined after detection, by the detection means 12, for a plurality of points, of the respective plane coordinates, in particular of transversal and longitudinal coordinates "X" and "Y", relative to the direction of feed, and of the respective height, or perpendicular coordinate "Z" relative to the batch lying plane.

Figure 6:
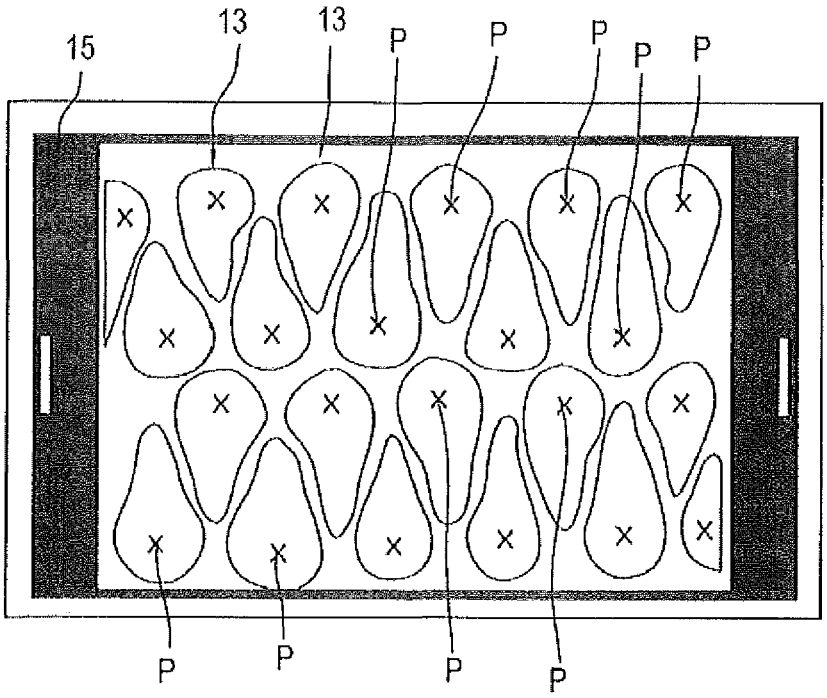
FIG. 6 is a schematic top plan view of a respective configuration of products, in particular showing the central or reference points of the areas inside which it is possible to apply a corresponding label.

Advantageously, as shown in FIG. 6, for each label application area, the electronic processing means determine a reference point P, in particular corresponding to the central point of said area, the reference point P having respective coordinates, in particular plane Coordinates, preferably respective transversal and longitudinal coordinates X and Y.

Starting from said points P, determined for each product 13, the electronic processing means determine the positioning, in particular transversal, of the application means 30.

Figure 7:
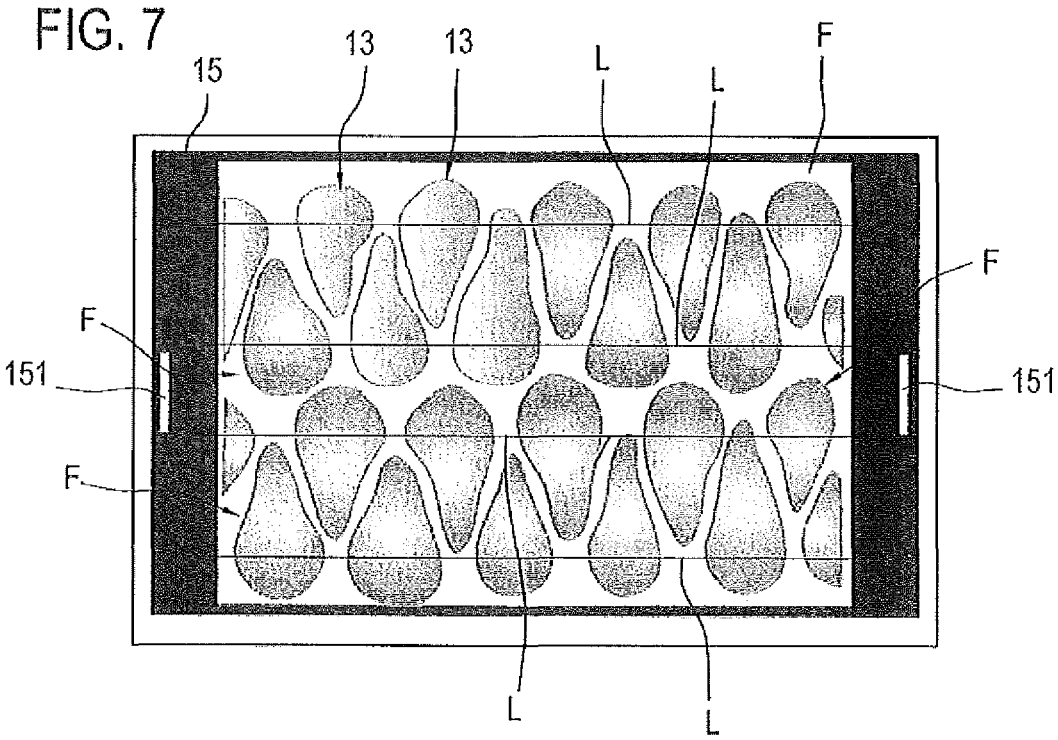
FIG. 7 is a schematic top plan view of the configuration of products shown in FIG. 6, in particular illustrating transversal operating or positioning lines of the respective label application devices, said transversal operating positioning lines being determined by the processing means of this apparatus.

In particular, said electronic processing means determine, for the respective longitudinal rows F of products, where each row comprises one or more products 13, the transversal operating position, indicated by a respective longitudinal line L in FIG. 7, of the respective label application device 30, the transversal operating position of the application device 30 being a position coinciding with or close to the respective transversal coordinate X of the reference point P of the respective products 13 of the corresponding row F of products.

Figure 5:
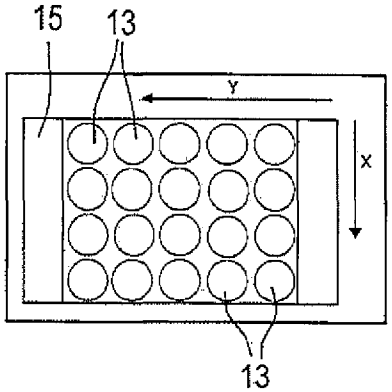
FIG. 5 is a plan view of a respective batch, or crate, of products, in particular showing the X-Y plane reference coordinates used by the electronic processing means of this apparatus for configuring the respective batch or crate of products.

Advantageously, the respective application device 30 is movable transversally, in particular along the axis of coordinate X in FIG. 5, and the electronic processing means position the respective application device 30 at the respective transversal operating position L, which coincides with or is close to the transversal coordinate "X" of the reference points P of the products of the respective row of products to be processed.

In particular, for each batch of products the application device 30 is movable transversally relative to the operating position which the same application device 30 had for labelling the previous batch of products.

In use, after operating on a respective batch of products, the application devices 30 move towards a new operating position, only when the new operating position is different to the operating position of the batch just processed. If the transversal operating position of consecutive batches of product coincides, the respective application device 30 does not perform any transversal movement.

In use, the electronic processing means, controlled by a respective program, determine, for the respective batch being processed, if the transversal position of the application device 30 coincides with the transversal operating position of the batch just processed, and, if that is not the case, they move the application device 30 to the respective and new transversal operating position of the batch to be processed. Otherwise, they keep the respective application device in the same transversal position.

The respective application device 30 applies corresponding labels with an application step which depends on the distance separating the reference points P of the products of the respective row F of products, in particular with an application step which is usually variable.

Advantageously, for optimum label application, the transversal operating position L of the application devices 30 is determined with reference to a corresponding batch starting point, in particular corresponding to an edge, particularly lateral, of the batch container or crate.

Depending on batch, or crate feed towards the label application zone, said starting point is positioned on the left side of the application unit, as illustrated. In a further embodiment, said starting point could be on the right side of the application unit, in particular if the batches of products were fed towards the application zone from the opposite side to the side of feed illustrated herein.

The electronic processing means also determine the maximum height of the container or crate of the respective batch of products.

In particular, said electronic processing means determine the maximum height of the container, or crate, 15, starting with the optical detection of it, carried out in the detection means 12.

In practice, the containers, or crates, which hold the respective batches of products may have different heights to one another.

These electronic processing means can determine the maximum height of each container, or crate.

In particular, for the example container, or crate, 15 used herein, said maximum height would be marked by the edge of a tab 151 projecting above the respective longitudinal end of the crate 15.

Starting with this data item, it is possible to determine the height at which the application devices 30 must be positioned relative to the belt 17 supporting the batches of product, so as to allow the passage of the respective batch of products under the lower face of said application devices 30, that is to say, under the lower face of the supporting frame of these application devices 30.

Advantageously, said detection means 12 are in the form of a respective laser profilometer.

Figure 8:
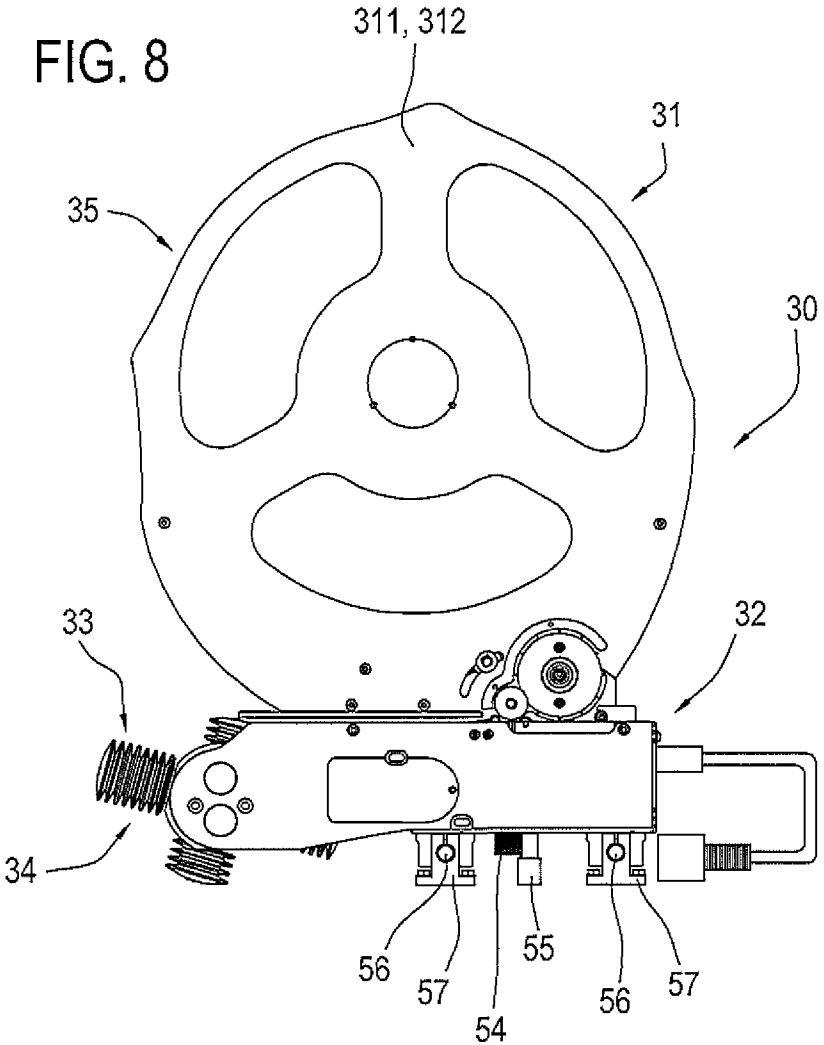
FIG. 8 is a side view of a preferred embodiment of a label application device.

The subsequent FIG. 8 illustrates a single label application device 30.

As can be inferred, the respective label application device 30 comprises a support for a label carrying web reel, labelled 31, and a base 32, which supports respective means for picking up and applying labels, comprising bellows means 34, which are mobile between a retracted position for picking up a corresponding label and an extended position for applying the labels on a respective product 13.

In particular, said label pickup and application means comprise a rotary carrousel 33, in particular rotating in a vertical plane, longitudinal to the direction of product feed, the rotary carrousel comprising a plurality of radial bellows 34, which are radially mobile between said label pickup and release positions.

Whilst the application device 30 moves relative to the products, in particular whilst the products are fed longitudinally below the respective application device 30, by means of the rotary wheel, the same application device applies the labels to the corresponding products of the respective row L of products an which the same application device 30 operates.

The speed of rotation of the carrousel 33 determines the longitudinal label application step.

The speed of rotation of the rotary carrousel (also called the bellows carrousel) 33 can therefore be suitably varied to create a label application step, which is suitably variable.

As may be interred from the subsequent FIGS. 8 to 13C, the label application means 30 therefore comprise means 35 for feeding the labels towards a point of label delivery to the pickup and application means.

In particular, the label feed means 35 therefore comprise supporting means 31 for a reel of label carrying web, said web being separable into a first and a second half-web downstream of the point of label delivery to the pickup and application means.

Figure 26:
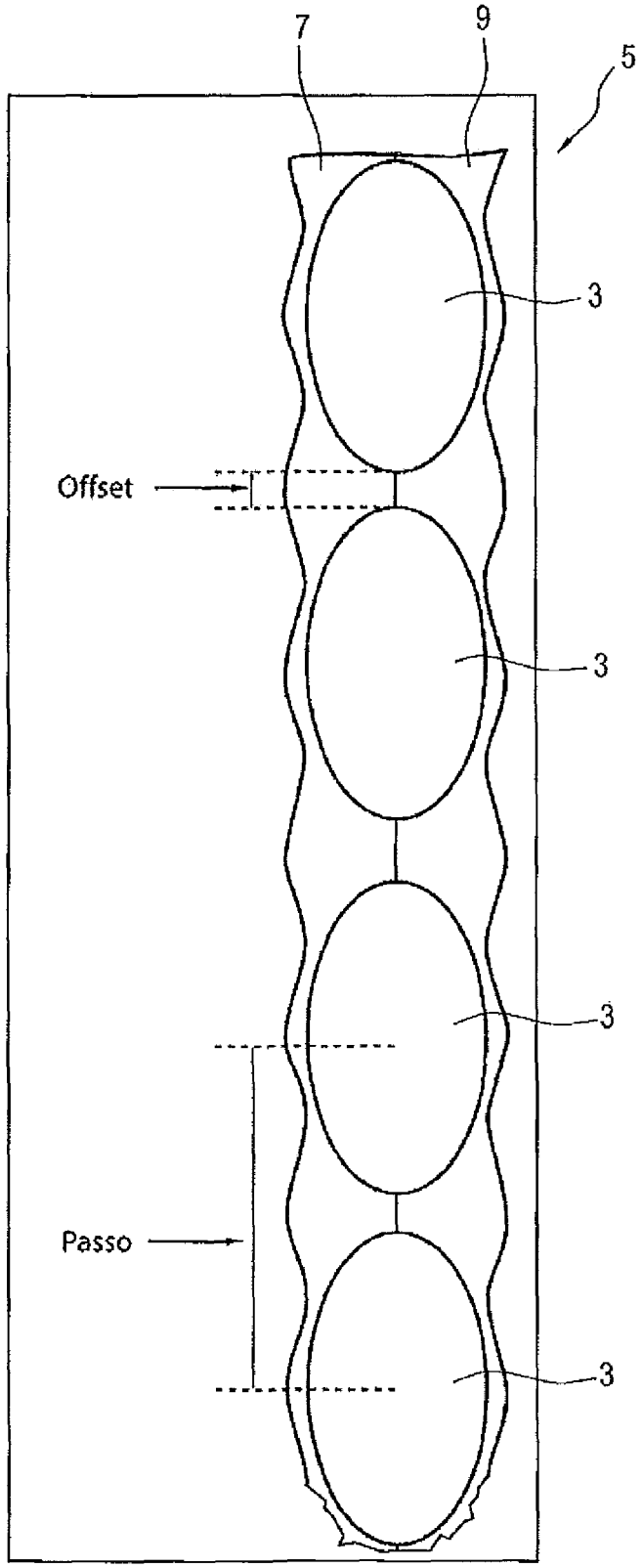
FIG. 26 shows a preferred embodiment of a label carrying web, illustrating the corresponding step and offset of the label carrying web.

In particular, as can be interred from the subsequent figures and in particular from FIG. 26, the label carrying web is labelled 5, whilst the portions of it, which are kept together by the labels 3, extending an both of said portions or half-webs, are labelled 7 and 9.

In particular, this embodiment of the web 5 has oval labels 3, the web 5 comprising a first and a second half-web 7, 9 side by side, having undulating edges, and which in the assembled condition support corresponding labels 3. When the labels are transferred pickup and application means, the half-webs 7, 9 are separated from one another. As illustrated, the respective label carrying web is identified by the "step" between the centers of the labels and by the "offset" parameter, that is to say, the distance between the ends of the labels.

There are advantageous sensor means, in particular in the form of a respective mechanical sensor 36, designed to detect the distance between consecutive labels 3, 3 of the labels carrying web 5, in particular close to the point of transfer of the labels to the pickup and application means.

Said sensor means 36, designed to detect the distance separating one label and the next label, are positioned on the supporting means, or base, 32 of the label pickup and application means.

In this way, it is in no way necessary to electrically connect the body 31, carrying the label carrying web feed means.

That advantageously simplifies the construction of this unit, that is to say, of the label application device 30.

For that purpose, in the upper plate 37 of the supporting means 32 of the carrousel 33, or label pickup and application means, a corresponding opening 371 is made, where the mechanical sensor 36 extends.

Said upper plate 37 of the base 32, supporting the label pickup and application means, in use, is opposite a plate 38 of the label carrying web feed means, the lower face of said plate 38 forming sliding means for the label carrying web 5 towards the dovetail end 39, which forms the point of transfer of the labels.

As can be inferred, even with reference to the subsequent FIGS. 14A to 14D, there are means for drawing the label carrying web 5, comprising free wheel means, in particular in the form of a first and a second free wheel 41, 41, which engage with the label carrying web and which, in particular, form means for engaging with and pulling the label backing half webs 7, 9, of the label carrying web 5.

Said free wheel means 41, 41, which engage with and pull the label carrying web, as illustrated, are external and coaxial to a central sliding roller 40 for the web 5 carrying the labels 3 to be applied.

Preferably, said free wheel means 41, 41 comprise respective toothed flanges or ring gears 411 for engaging with the respective half-web 7, 9.

As illustrated, a respective toothed wheel 42 for meshing and drawing is fixed to, or in a single body with, said central roller 40, and extends at one lateral end of it.

The toothed wheel 42 is designed to draw in rotation the central roller 40 and the wheels 41, 41 which engage with and pull the label carrying web.

In particular, as can be interred from FIG. 140, the respective free wheel 41 comprises a first and a second flange 412, 413. Extending and retained between these is the ring gear 411 for meshing with the respective half-web of the label carrying web 5, as well as a respective rotary support central bearing 414.

Figure 10:
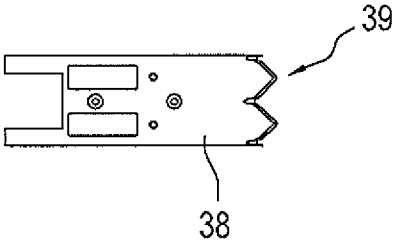
FIG. 10 is a top plan view of the lower plate of the label feed reel supporting body, or frame.

As can be inferred, in particular from FIG. 10, the label carrying web drawing means are supported by the supporting frame 31 of the label carrying web reel 5.

Figure 12:
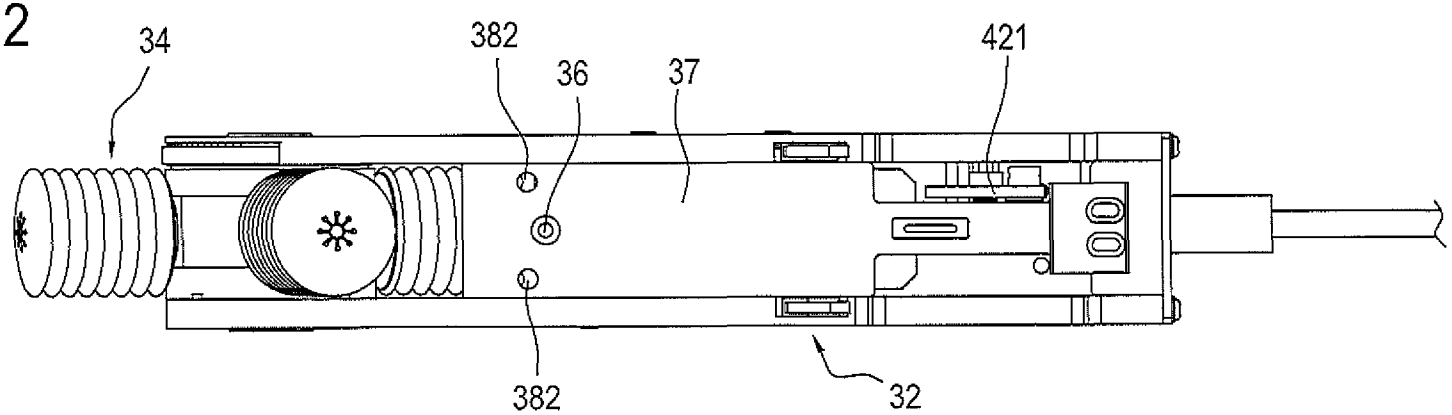
FIG. 12 is a top plan view of the supporting base of the label pickup and application bellows elements.
Figure 13A:
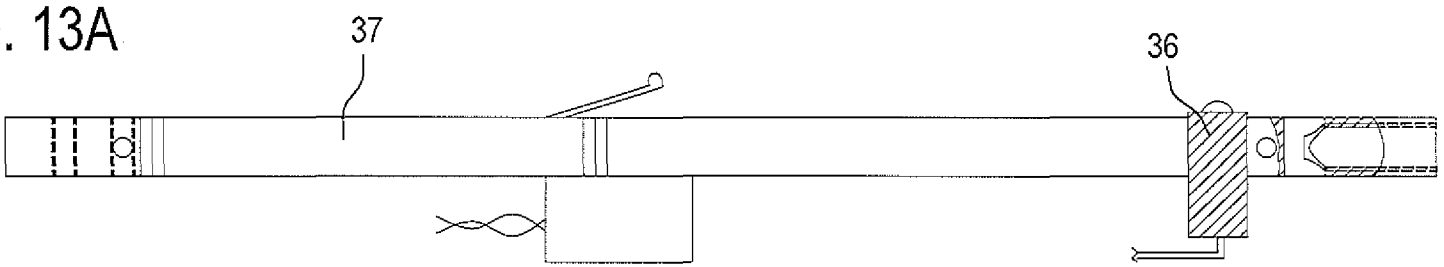
FIG. 13A is a longitudinal section of the upper plate of the supporting base of the label pickup and application bellows unit.
Figure 13B:
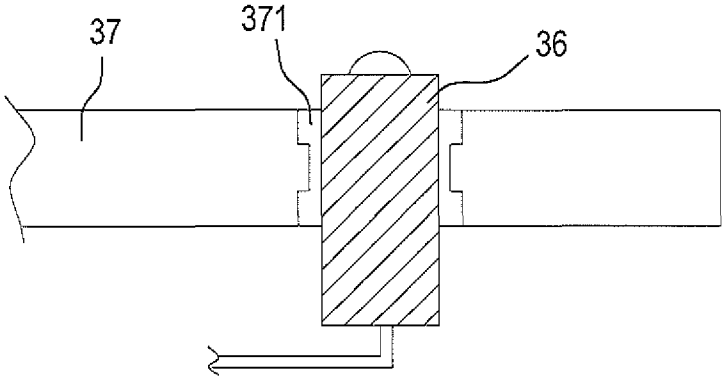
FIG. 13B is a detail of the longitudinal section view of FIG. 13A of the upper plate of the bellows unit supporting base.
Figure 13C:
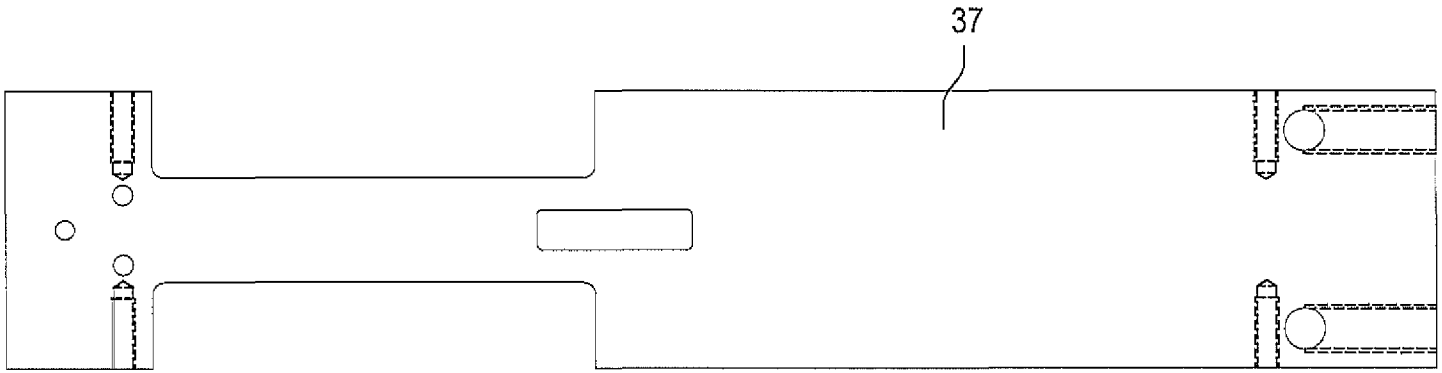
FIG. 13C is a plan view of only the upper plate of the bellows unit supporting base.

In particular, as may be interred from FIG. 12, the numeral 421 denotes a respective ring gear for meshing with the ring gear 42, which operates the label carrying web 5 feed means. Said ring gear 421 is provided on the supporting base 32 of the bellows carrousel and is suitably motor-driven.

Figures 14A, 14B, 14C, 14D:
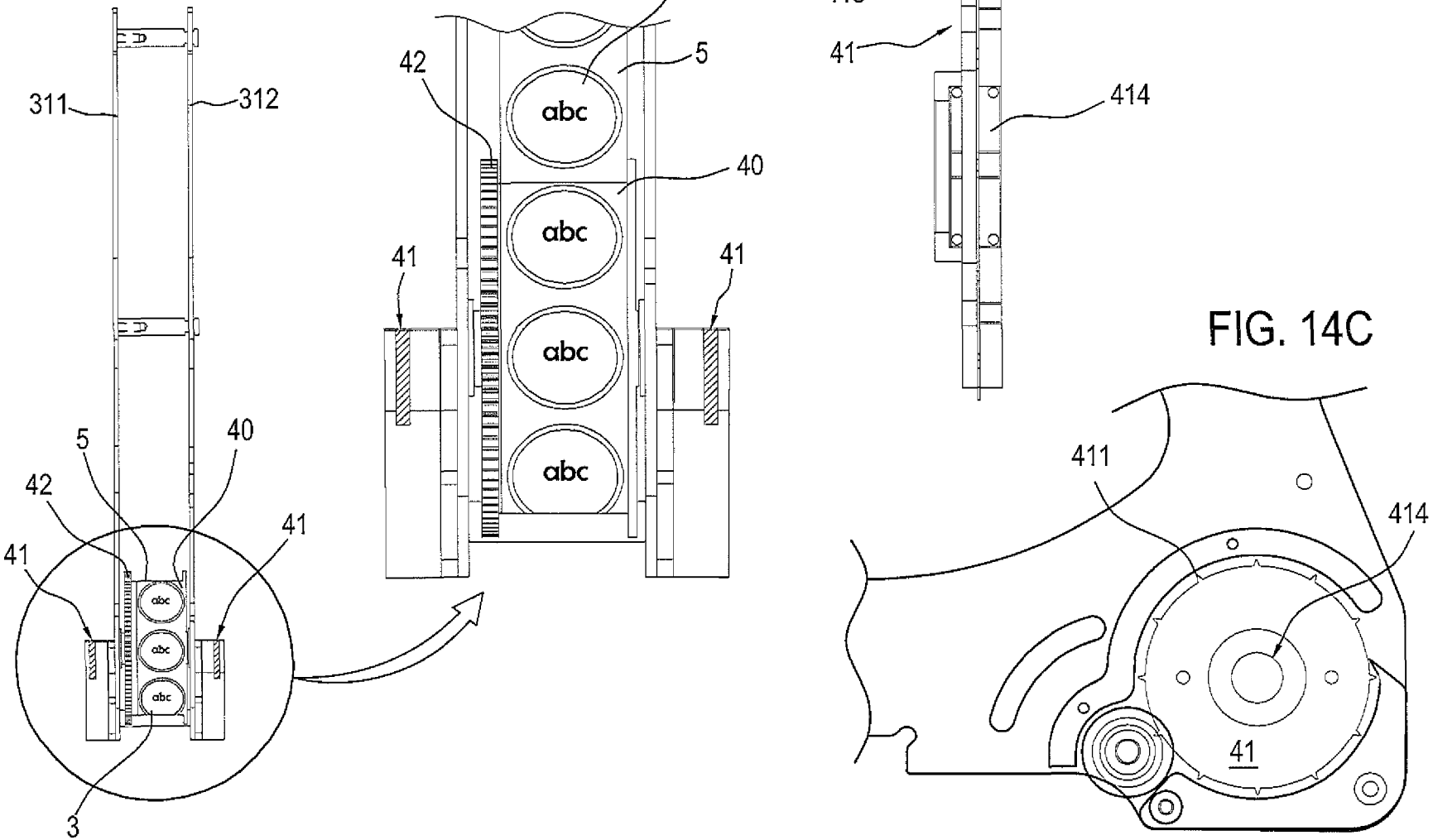
FIG. 14A is a top plan view, with a detail of the drawing zone, relating to the label feed unit.
FIG. 14B is an enlarged detail of the drawing zone of the label feed unit.
FIG. 14C is a side view of the drawing zone of the label feed unit, with a detail showing the free wheel means for engaging with and drawing the label carrying half-webs.
FIG. 14D is a diametral section of the free wheel means for engaging with drawing the label carrying half-webs.

In particular, as can easily be interred from FIGS. 14A and 14B, the label carrying web 5 reel is supported by corresponding shaped flanges 311, 312, extending laterally to the reel support zone and on the extension of the lateral ends of the plate 38 of the supporting frame 31. As illustrated, outside said shaped flanges 311, 312 are said wheels 41, 41 for engaging with and drawing the half-webs, whilst the central roller 40 is between the shaped flanges 311, 312.

Figure 15:
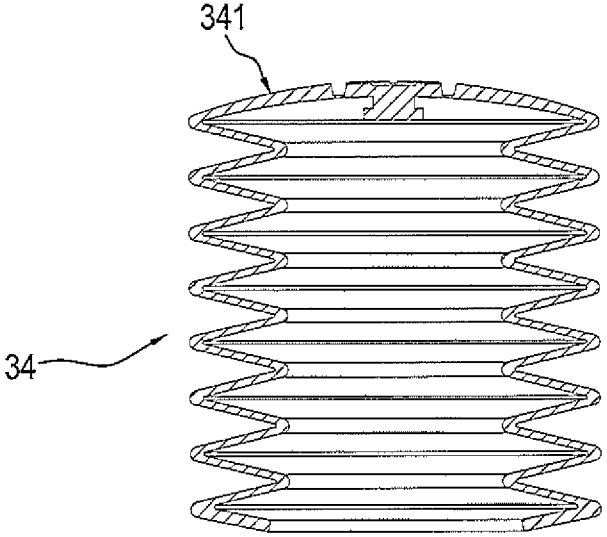
FIG. 15 is a longitudinal section of a corresponding bellows element according to this invention.
Figure 14F:
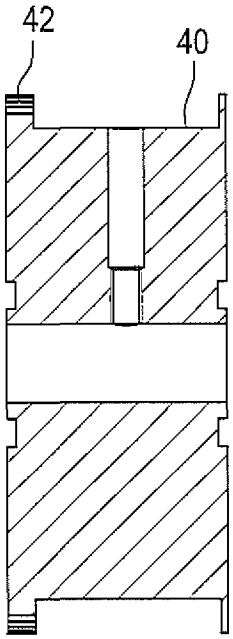
FIG. 14F is a cross-section according to the line XIVF-XIVF of FIG. 14E.
Figure 14E:
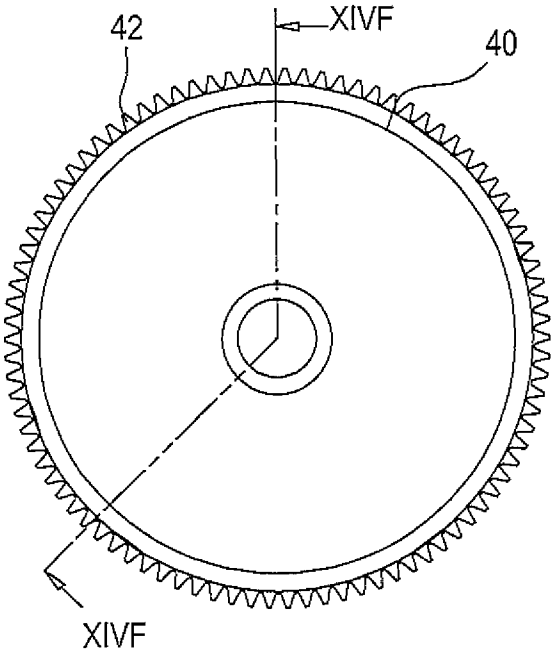
FIG. 14E is a side view of the central roller for engaging with the label carrying web used in the drawing zone of the label feed unit.

As can be inferred with reference to the subsequent FIG. 15, the bellows element 34 comprises an end face 341 for picking up the respective label which is arched, in particular arched with a radius of curvature of between 50 mm and 80 mm, preferably between 60 mm and 70 mm, optimally between 64 mm and 68 mm. The preferred embodiment of the bellows element illustrated herein has a radius of curvature of the end face 341 equal to 66 mm.

This apparatus comprises advantageous temporary storage means for the batches of product. The storage means are positioned between the detection means 12 and the label application means 10.

In this way, it is possible to ensure that the detection means 12 and the label application means 10 operate separately from one another.

The storage means are, in particular, formed by the means 17 for feeding the products towards the label application section, or means 10.

In particular, said product batch storage means comprise at least one storage station, in particular a first and a second sequential storage stations, one after another, in an intermediate position between the detection means 12 and the label application means 10.

Advantageously, the data relating to the batches of product detected by the detection means 12 is used, in this apparatus, to manage the respective batch 12, in particular in these label application means or downstream of the label application means 10, for example for conveying the batches of product towards respective and specific destinations or outfeeds of this apparatus.

Advantageously, the label application devices 30 are vertically mobile, in particular height-adjustable, in particular depending on the height dimension, or maximum height, of the container, or crate, 15 of the respective batch of products.

In particular, as can be inferred in particular with reference to FIGS. 2 and 4, the label application devices 30 are supported by a respective and shared frame 303, which is connected to the main supporting framework of the apparatus by corresponding height positioning means 50, comprising, in particular, a respective motor 51 defining a respective electric axis which is connected to a respective telescopic shaft 53, directly supporting the shared supporting frame 303 of the application devices 30. As already indicated, the label application device 30 is composed of a respective frame 32, supporting the label pickup and application means, above which the frame 31 can be fixed 31, supporting the label feed means, that is to say, the label carrying web feed means.

Figure 11:
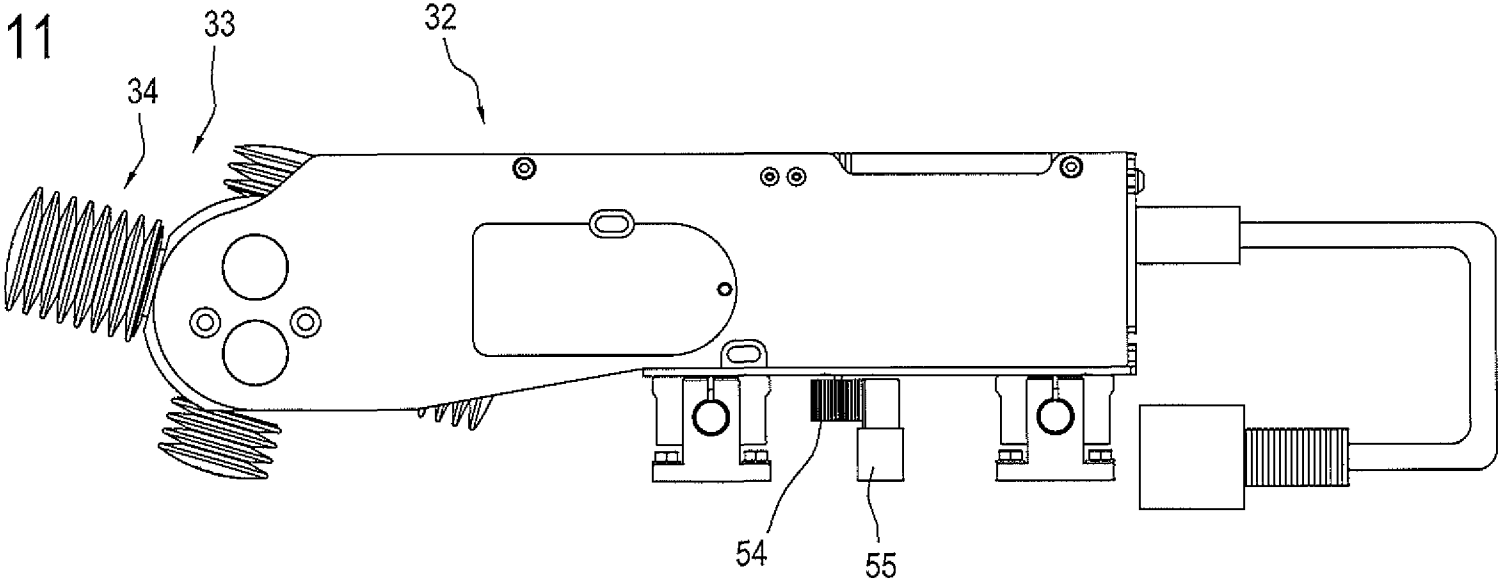
FIG. 11 is a side view of the supporting body, or base, of the label pickup and application bellows elements.

Advantageously, the electric actuators for movement of the label web drawing means, rotation of the bellows carrousel, and transversal movement of the respective application device 30, are supported on the supporting base 32 of the means (e.g., the rotary carrousel 33 with bellows 34) for picking up and applying the labels and these are powered by a single connector, as shown in particular in FIG. 11, with a considerable saving and construction advantage. Advantageously, also supported on the supporting base 32 of the means for picking up and applying the labels and powered by a single connector, there is a corresponding sensor, in particular centrally positioned, for detecting the end of the label carrying web 5, sensor means for the position of the bellows, not shown in detail in the accompanying drawings, plus said means 36 for detecting the distance between the labels.

Advantageously, as FIG. 8 clearly shows, for the transversal movement of the application device 30, a toothed wheel 54 is used, meshing with a rack 55 fixed to the framework of the apparatus.

For that purpose, the respective application device 30 is guided on corresponding transversal guide means, in particular comprising a first and a second guide 56, 56. Extending between the first and the second guides is the rack for transversal meshing.

As can be interred from FIG. 8, the toothed wheel 54 extends below the base 32 and meshes with the rack 55. Moreover, the base 32 also comprises respective shoes 57, 57 able to slide on corresponding guide rods 56, 56.

Figure 9:
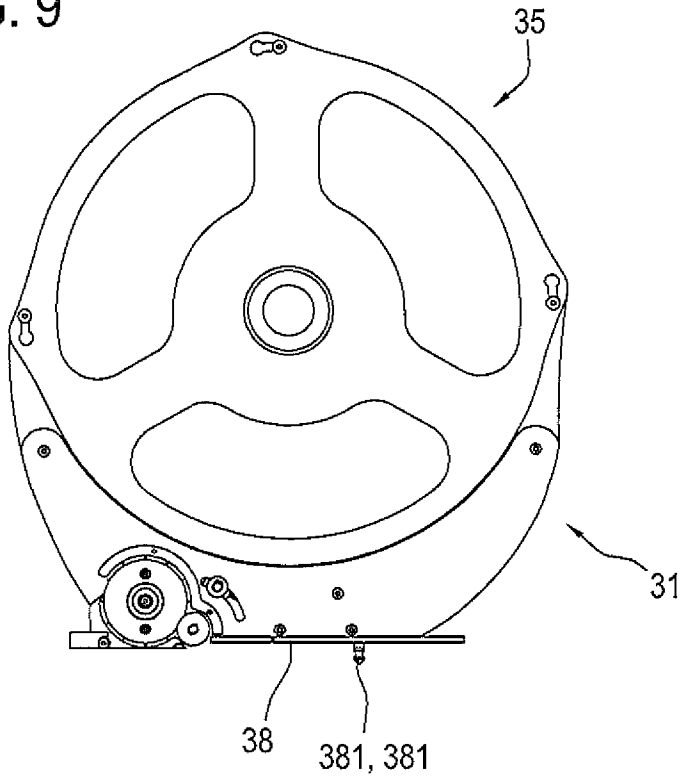
FIG. 9 is a side view of only the label feed reel supporting body, or frame.

As can be inferred, in particular with reference to FIGS. 9 and 12, to apply or associate the label carrying web supporting and feed means to the bellows supporting base 32, or label pickup and application means, only pin means are needed, in particular in the form of a first and a second pin 381, 381. The pin means project below the plate 38 and are inserted in corresponding holes 382, 382, made in the upper plate 37 of the base or means supporting the application bellows 34.

In this way, it is possible to provide fast, easy application of the means 31 supporting a respective label carrying web reel to the base 32, which drives the label feed means 31.

Figure 16:
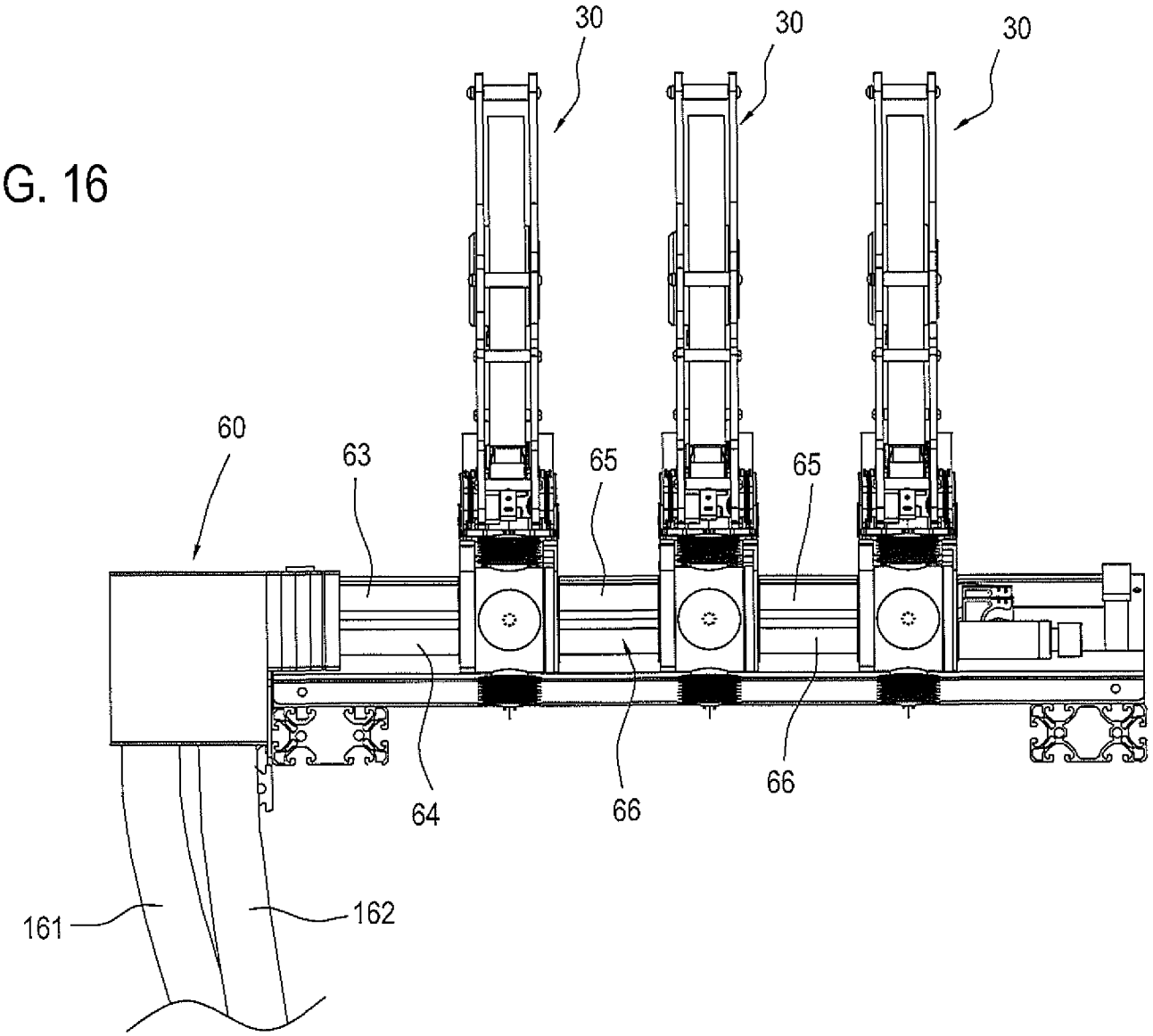
FIG. 16 is a detail of the means for feeding or transmitting compressed air and air suction to the label application devices.
Figure 17:
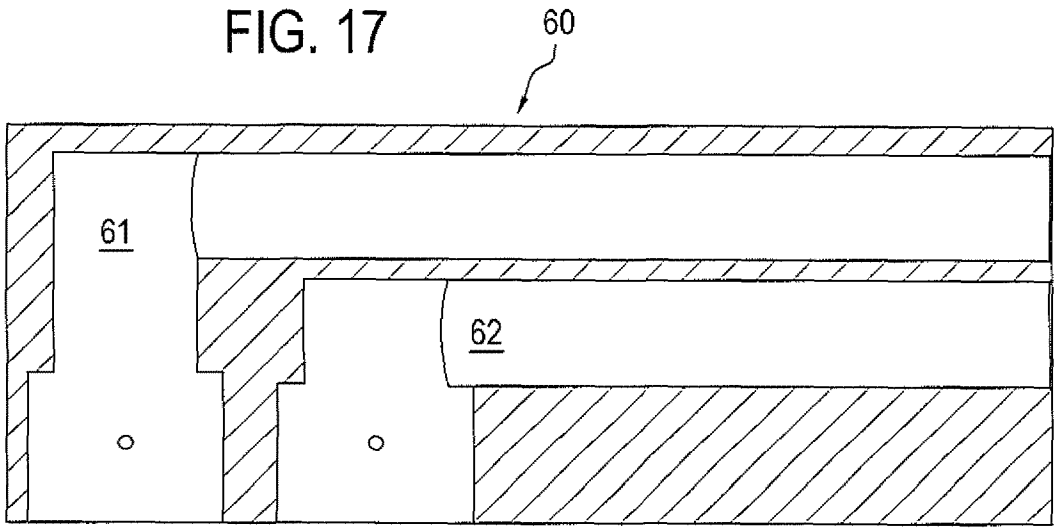
FIG. 17 is a cross-section of the manifold for feeding compressed air and suction to the label application devices.
Figure 18B:
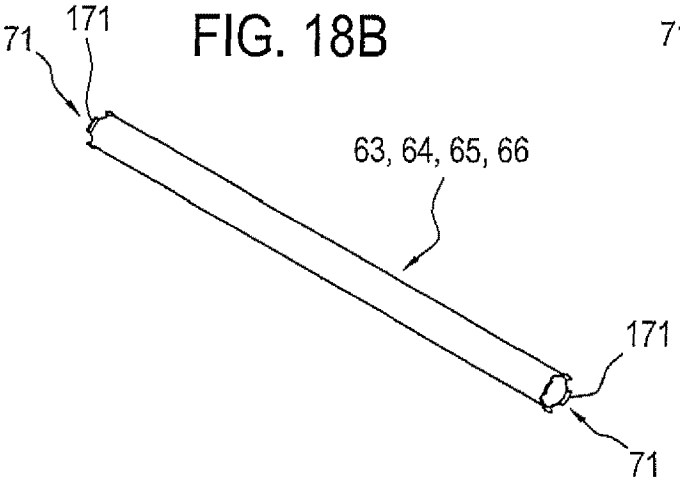
Figure 18C:
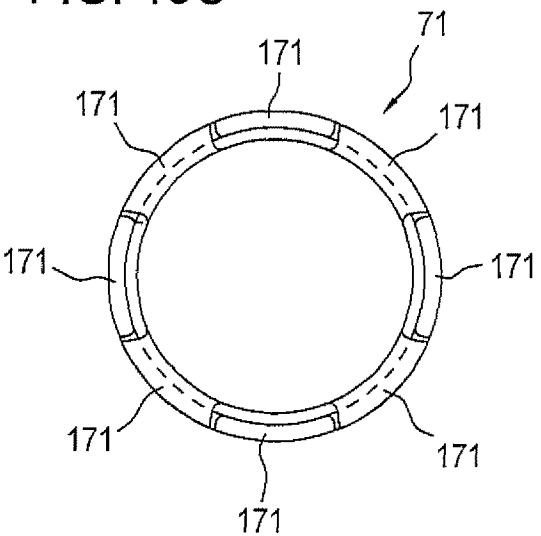
Figure 22:
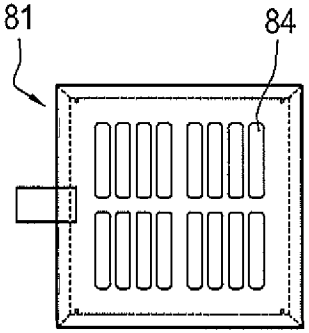
FIGS. 21 to 23 show, respectively in a side view, a top plan view and a longitudinal section, only the upper part of a preferred embodiment of means for collecting and grinding the half-webs obtained from the label carrying web.
Figure 21:
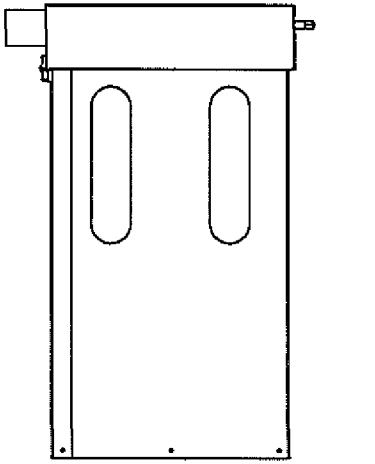
Figure 23:
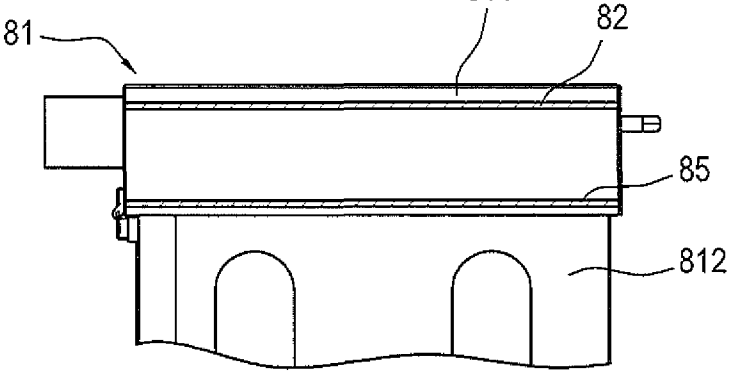

Advantageously, as can be interred from the subsequent FIGS. 16 and 17, there are means 60, designed to connect the respective label application devices 30, respectively, to a compressed air source and to a suction source.

Said means for connecting, or conveying the compressed air or air suction comprise a respective manifold body 60, having a first compression duct 61 and a second suction duct 62. The manifold body 60, in particular made of suitable metal material, is fixed to the supporting means of this apparatus and in particular to the supporting frame of a corresponding battery of label application devices 30.

Respective flexible ducts 161, 162 extend from the manifold body 60. Said flexible ducts connect the respective compressed air or air suction sources.

Extending from the manifold body 60 there are respective first and second ducts 63, 64, respectively for the compressed air and air suction, which connect a first label application device 30 of the respective transversal row of application devices, and extending from this application device 30 there are corresponding first and second intermediate ducts 65, 66, which extend between corresponding application devices 30 and are designed to transmit said compression and suction between said application devices 30.

Figure 18A:
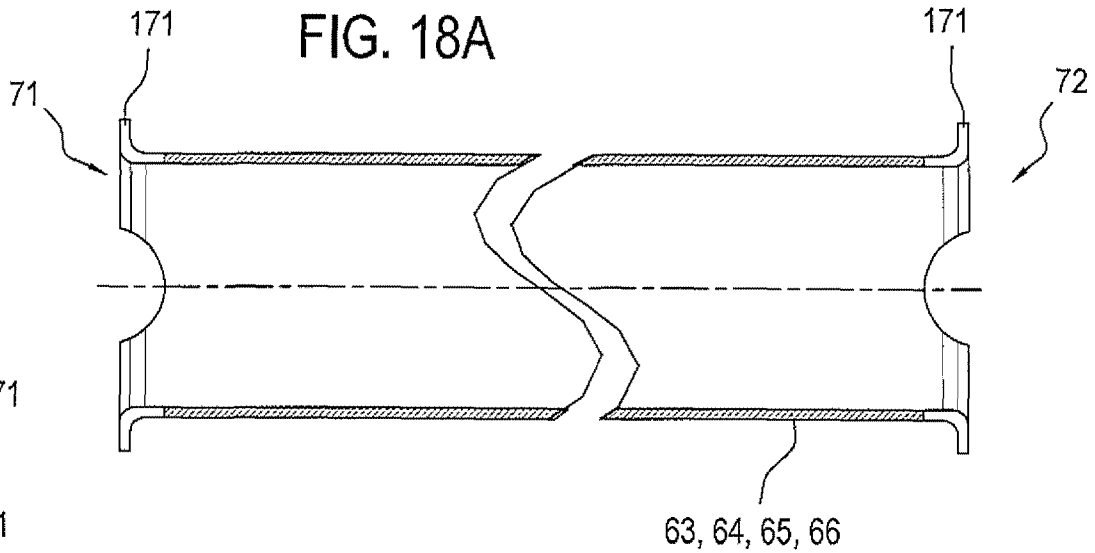
FIGS. 18A, 18B and 18C are respectively a longitudinal section, a far perspective view, and a front view of the duct for transmitting suction and/or compressed air to the respective label application devices.
Figure 20B:
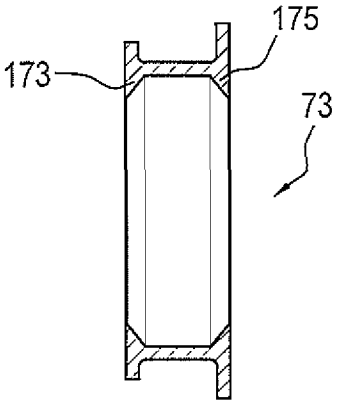
FIGS. 19, 20A and 20B show, respectively in a perspective view, a cross-section and a side view, an advantageous gasket designed to receive the ducts of the compressed air and suction means and located at a respective label application device.
Figure 19:
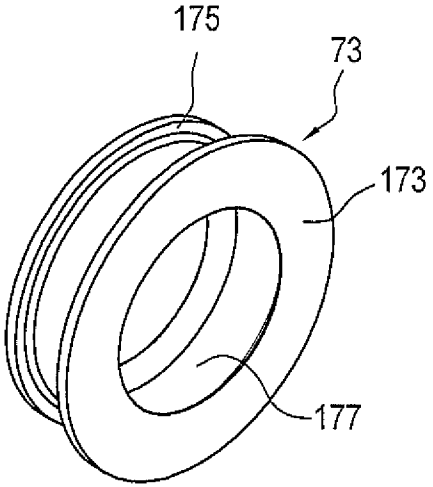
Figure 20A:
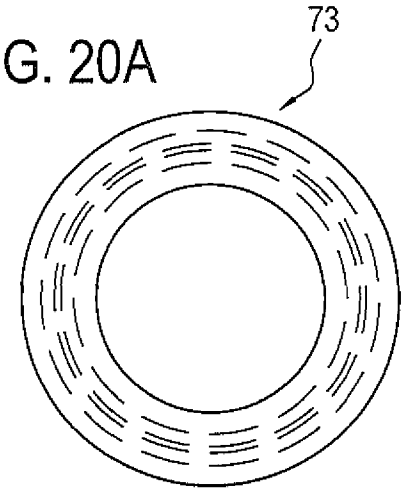
Figure 24A:
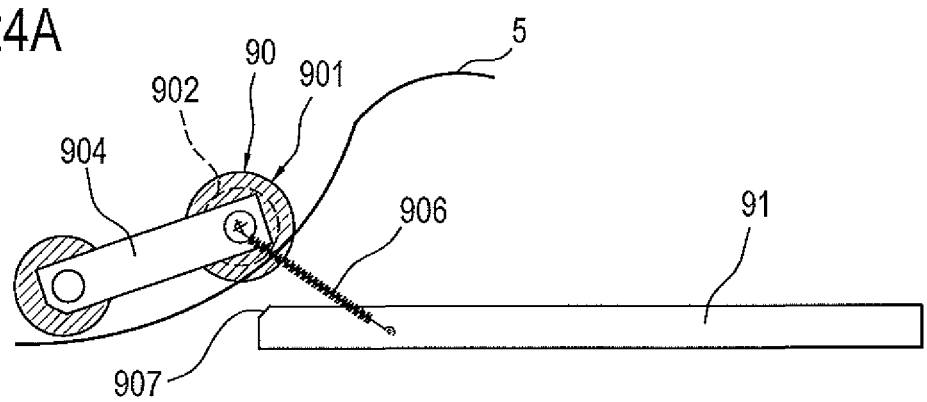
FIGS. 24A, 24B and 25A, 25B show, respectively in vertical and horizontal sections, related different operating positions of a preferred embodiment of corresponding rocker arm means for tensioning and braking the sliding of the label carrying web on the label feed means.
Figure 24B:
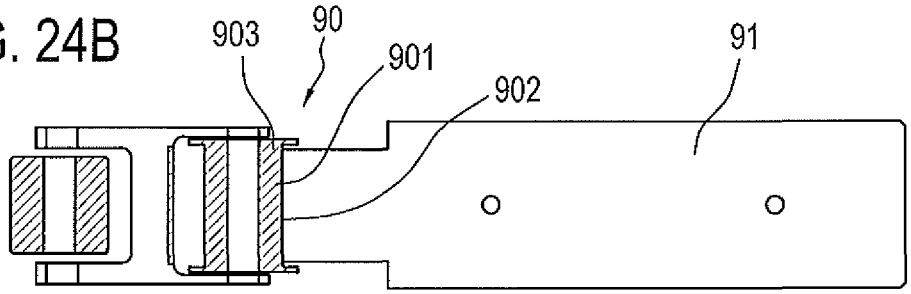

Each of said connecting ducts 63, 64, 65, 66 is made of metal material and, as illustrated in FIGS. 18A to 180, comprises respective ends, designed to be coupled to corresponding sliding connection and seal gaskets, whose shape is illustrated in the subsequent FIGS. 19, 20A and 20B.

In particular, as illustrated, said ducts 63, 64, 65, 66 for transmitting compression and/or suction are in the form of a respective tubular body, whose ends 71, 72 are provided with longitudinally flared radial teeth 171, allowing the respective end 71, 72 to be coupled, in particular to be inserted, in a corresponding O-ring 73, with flanged lateral ends, or walls 173, 175, designed to receive the ends 71, 73 of the respective tubular connecting bodies. The O-rings 73 allow axial sliding of the tubular bodies 63, 64, 65, 66 in the circumferential wall 177 of the O-ring 73, thereby allowing the transversal positioning movement of the application devices 30. In particular, as illustrated, the radial teeth of one respective end 71 of the tubular bodies are longitudinally offset relative to the radial teeth of the opposite longitudinal end 73.

Figure 31:
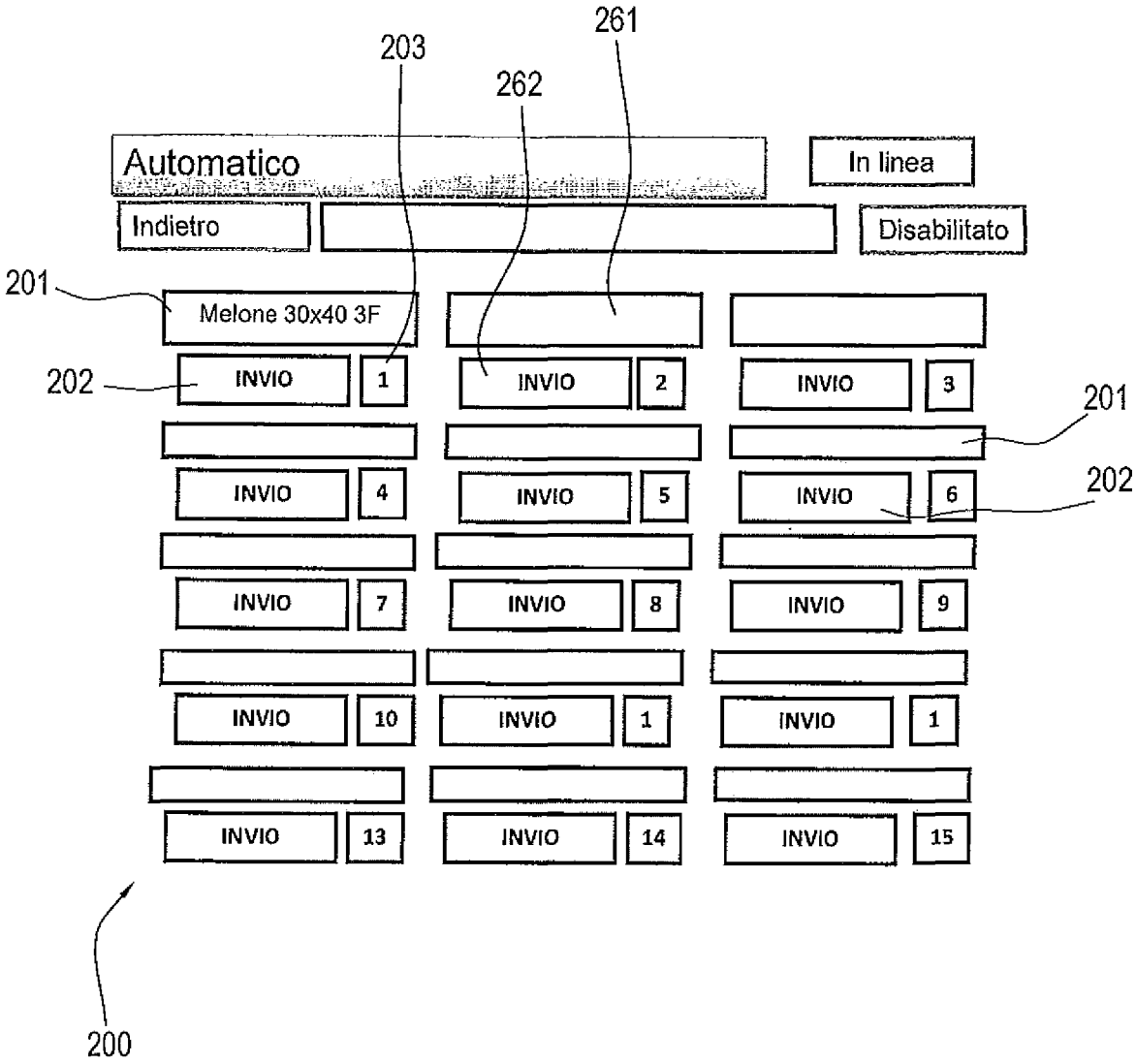
FIG. 31 shows a screen page for advantageous selection of recipes of products to be labelled.

As can be interred from the subsequent FIGS. 31 to 33, there are also advantageous recovery means 80 for the backing bands or half-webs 7, 9 of the labels on the label carrying web 5. The recovery means 80 are in the form of means designed to suck, grind and collect the half-webs 7, 9 in a respective container 81.

The collection container 81 comprises a respective upper grille 84 from which the waste half-web suction air can come out, in particular towards the outside environment, that is to say, the environment in which this apparatus is located. Advantageously, the collection container 81 therefore comprises a corresponding filter 82 for the air which flows from inside the container to the environment outside said container 81.

In the drawings, the numeral 83 denotes means for grinding the half-webs 7, 9 of the label carrying web, which are sucked by the application devices in turn, the numeral 85 denotes a gasket between the openable lid 811 and the main body 812 of the collection container 81.

In particular, the means 80 for collecting the waste half-webs 7, 9 are mobile in such a way as to allow suitable positioning of the collection means 80 relative to the apparatus and to the environment in which the apparatus is located. For that purpose, the collection means 80 are supported by corresponding wheels.

As may be interred from the subsequent FIGS. 24A to 25B, on the label carrying web feed means 31 there are tilting means 90, designed to engage with and keep under tension said label carrying web 5, as well as being designed to form means for stopping, or braking, the label carrying web 5, in the latter case operating in conjunction with corresponding fixed means 91. In particular, said label carrying web 5 tensioning and/or feed stopping means 90 comprise a label carrying web sliding roller 901, having a cylindrical surface 902 which engages with the label carrying web 5 and projecting lateral flanges 903 for containing or centering the label carrying web. The sliding roller 901 is rotatably supported by a tilting frame 904 which at the opposite end comprises a second sliding roller 905.

Figure 25A:
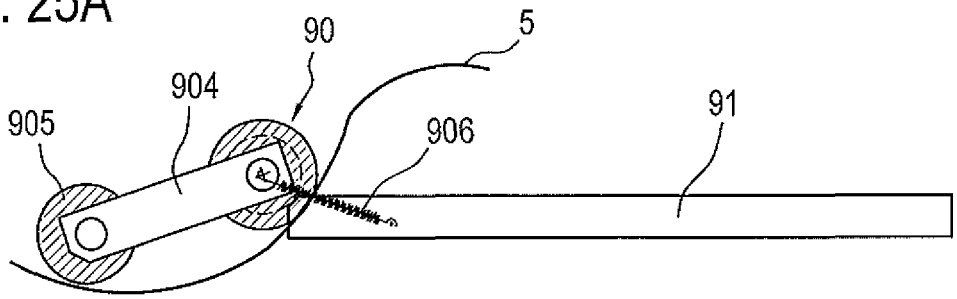
Figure 25B:
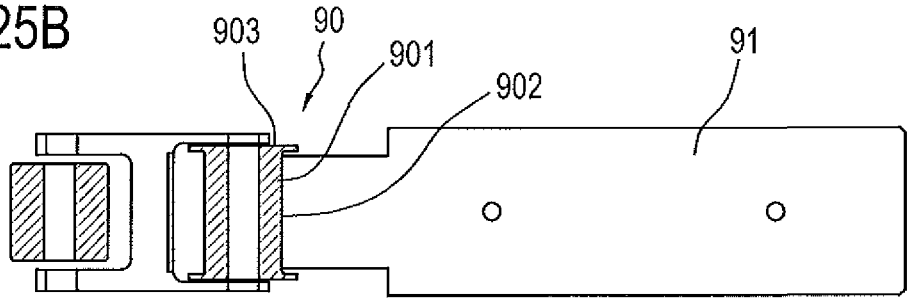

There are also elastic means 906, acting as tensioning means of the label carrying web sliding means and which, in particular, return the roller 901 towards a braking position, illustrated, in particular, in the subsequent FIG. 25A, in which said sliding means 901 lock the label web between the sliding surface 902, in particular of the corresponding roller 901, and an opposite fixed surface, in particular the surface 907 of a plate 91 forming part of the supporting frame of the label web feed means. The spring 906 elastically returns the roller 901 against a plate 91, which is interposed between the lateral walls of the label carrying web 5 reel supporting means.

Data relating to the various processing in progress is saved in the control means of this apparatus. Once set, this data can be retrieved to carry out corresponding processing and can be modified if necessary.

In particular, a related library of the control system can be used to save various files defining respective preset operating parameters. In particular, a respective library file could be distinguished by the respective name of the label and contain data intended to define the size, step and offset of the labels of the respective label carrying web, from which it is possible to define the feed speed of the label carrying web, during the application steps.

Moreover, a corresponding library may also be used to save files containing data relating to the type of fruit or product being processed and to specific parameters of the fruit or product.

As can be interred with reference to the subsequent FIGS. 27A to 27D, this system can operate starting with preset recipes for product or, product batch or crate configurations.

For that purpose, the electronic processing means of this apparatus comprise a plurality of preset recipes, defining respective product or product batch configurations, and in particular there are interface means, or screen pages, on the related display of the electronic processing means, which are designed to allow the selection and/or definition, or modification, of the respective recipe to be processed.

Figure 27A:
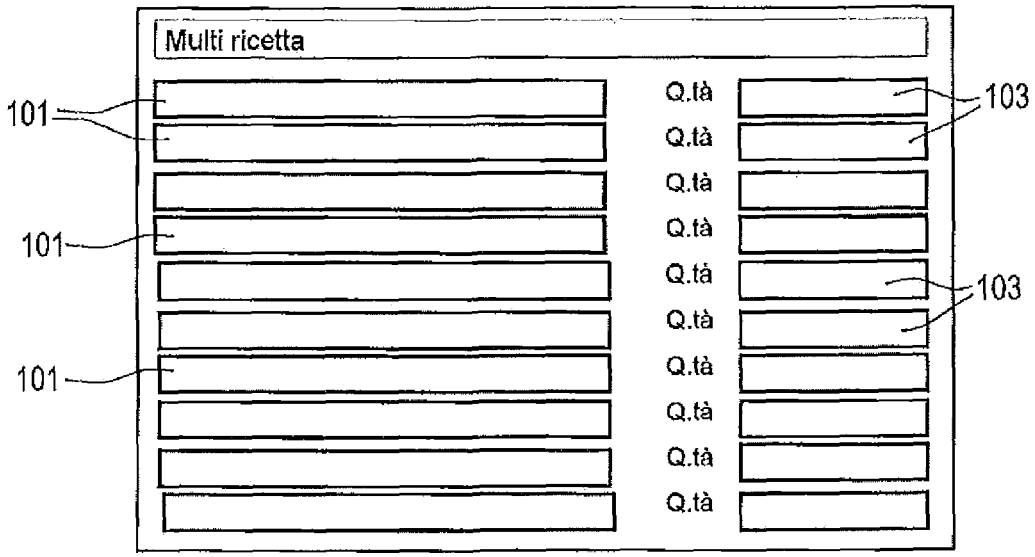
FIGS. 27A, 27B, 27C, 27D show respective screen pages, or graphical interfaces, generated by the electronic processing means of the apparatus, relating to the management of corresponding preset recipes for the configuration of products or batches.

In particular, FIG. 27A shows a first screen page, retrievable on the display of the electronic processing means of the apparatus, showing a menu, called multi-recipe, which can be used for programming an operating step of this apparatus. The multi-recipe menu shown in FIG. 27A allows the retrieval of respective product or product batch, or crate, configurations 101, starting with a list of recipes available. An active window, or box, is associated with each recipe for the entry of a corresponding data item 103, relating to the quantity of batches, or crates, of products to be processed, preferably in sequence.

Figure 27B:
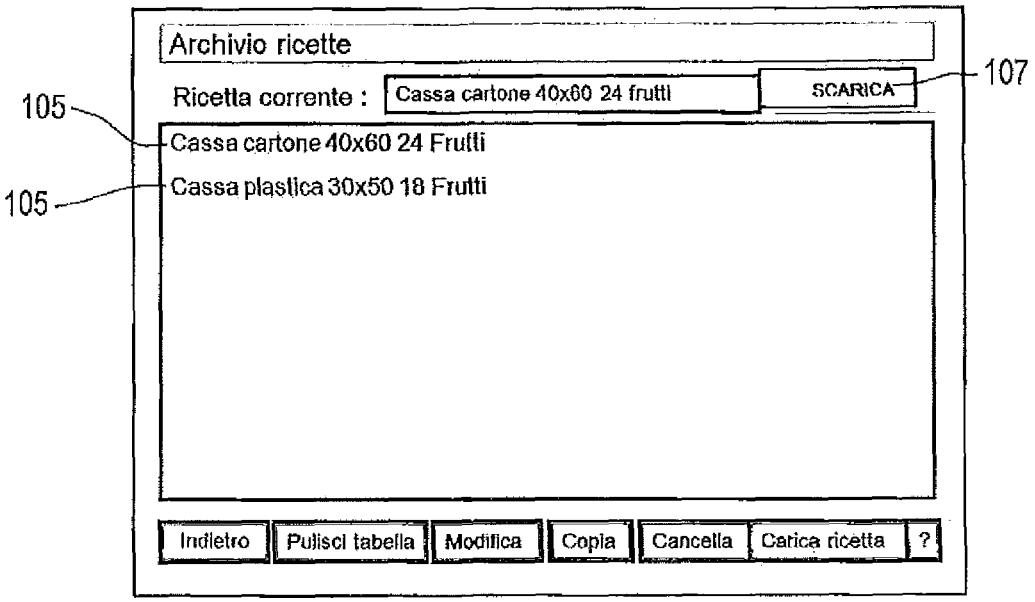
Figure 27C:
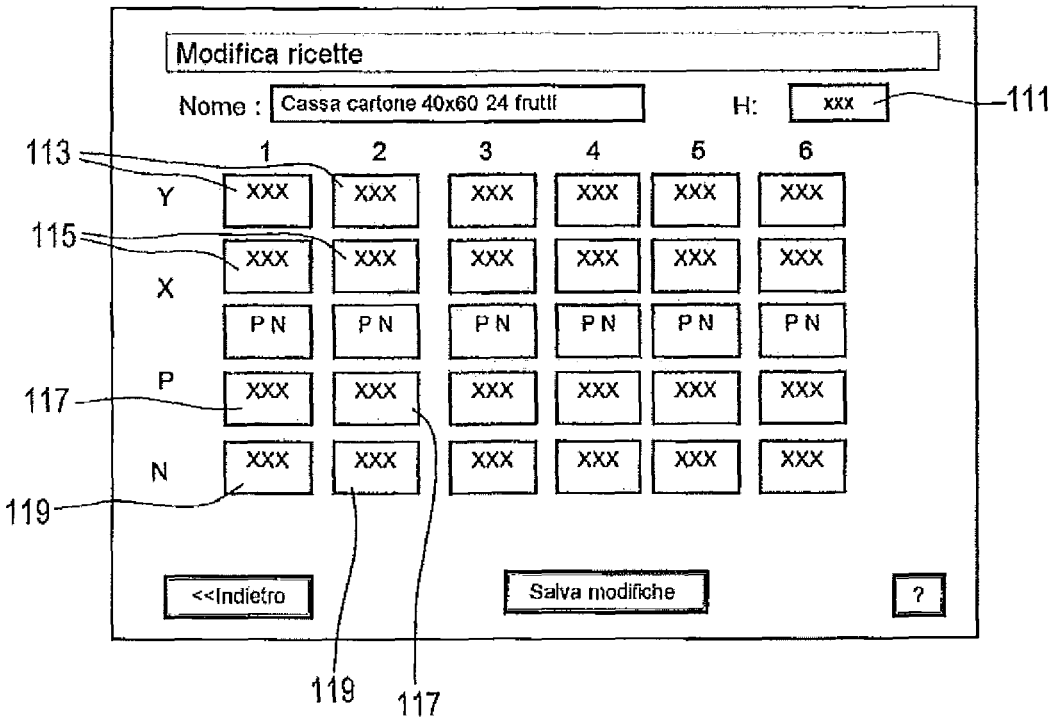

In particular, as may be interred from FIG. 27B, the processing system of this apparatus has a second screen page, relating to an archive of respective product, or crate or batch, configurations, 107, having respective preset operating parameters, which can easily be selected, and entered in the main multi-recipe screen page using the "download" key 107.

Moreover, the processing system has a third screen page, which for each recipe in the archive allows access to a modify recipe menu, as shown in FIG. 270, showing not just the name identifying the respective product, or crate, or batch of products configuration, but also an active window, or box, 111 relating to a parameter corresponding to the maximum height of the crate, or batch, respective active windows, or boxes, 113, 115 relating to the parameters of plane coordinates X and Y, plus respective active windows, or boxes, 117 relating to the step P, or distance between products in a respective strip, or row, of products aligned according to the longitudinal line, and respective active windows, or boxes, 119 relating to the number N of products in a single strip or row of products.

Figure 27D:
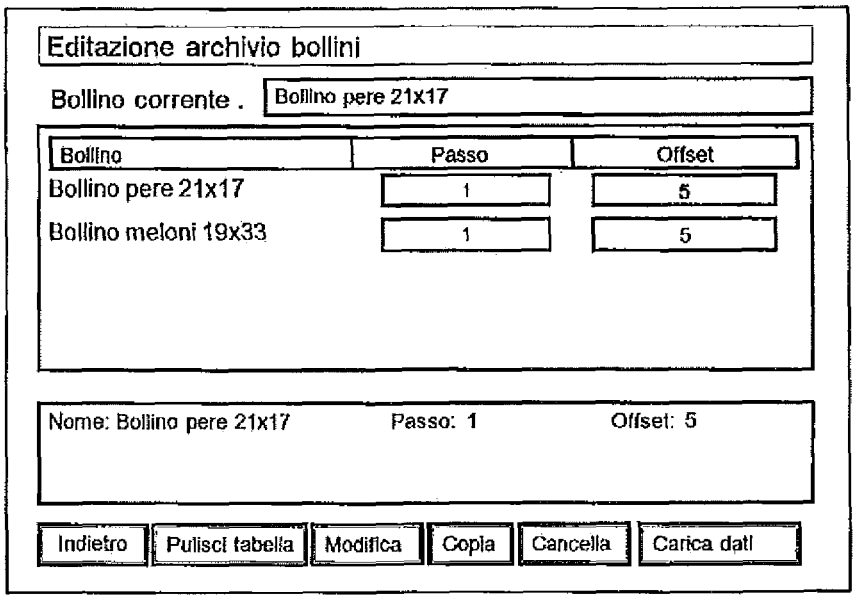

The subsequent FIG. 27D shows a further screen page relating to the label, generated and used by this control system to define the respective label web recipe, in which the respective label configuration is identified by a label name and in which there are also the label longitudinal and transversal dimensions, as well as the respective feed step and offset parameter.

However, it shall be understood that this apparatus is particularly suitable for processing labels which have any desired configuration or shape, in particular oval, round, rectangular or square. Moreover, the label web could have shaped sides, as illustrated, or sides which are completely straight, this making no difference. Advantageously this means that this apparatus has excellent operating flexibility.

In conformity with a further preferred embodiment, the product detection means may comprise a first, and if necessary a second, laser beam emitter and a video camera, or camera, for capturing images of the product. This is connected to corresponding electronic processing means, preferably in the form of an industrial PC, if necessary able to control the entire plant, or a corresponding unit, or section, of said plant, in which the detection means are fitted. Or, as in the case of this preferred embodiment, and as is particularly preferred, an industrial PC designed to control only the product detection means.

Advantageously, the laser emitter, which operates in a condition without lighting, that is to say, in the dark, allows the product to be lit, defining an illuminating scan with a "blade" configuration.

While the laser emitter scans the product, the video camera, or camera, in turn captures several images, or shots, in sequence, of the products which are lit by the laser beam. Said images, or shots, define various profiles of the products to be detected.

The video camera, or camera, then pre-processes the detected images, or shots, using corresponding electronic processing means belonging to the self-same video camera or camera.

Said images, or shots, pre-processed by the video camera are then sent to the processing means, or industrial PC, which, using a special image processing program, starting with the profiles detected and pre-processed by the video camera, or camera, definitively reconstructs the configuration of the batch, or crate, of products to be detected, in particular the profile of the products of the corresponding batch and if necessary also of the container, or crate, containing them.

Starting with that configuration of the batch, or crate, of products detected, the parameters which allow identification of the specific recipe, or product configuration are inferred. The recipe parameters for it are sent to the processing system, in particular in the form of a PLC, which manages the label application means.

Figure 28A:
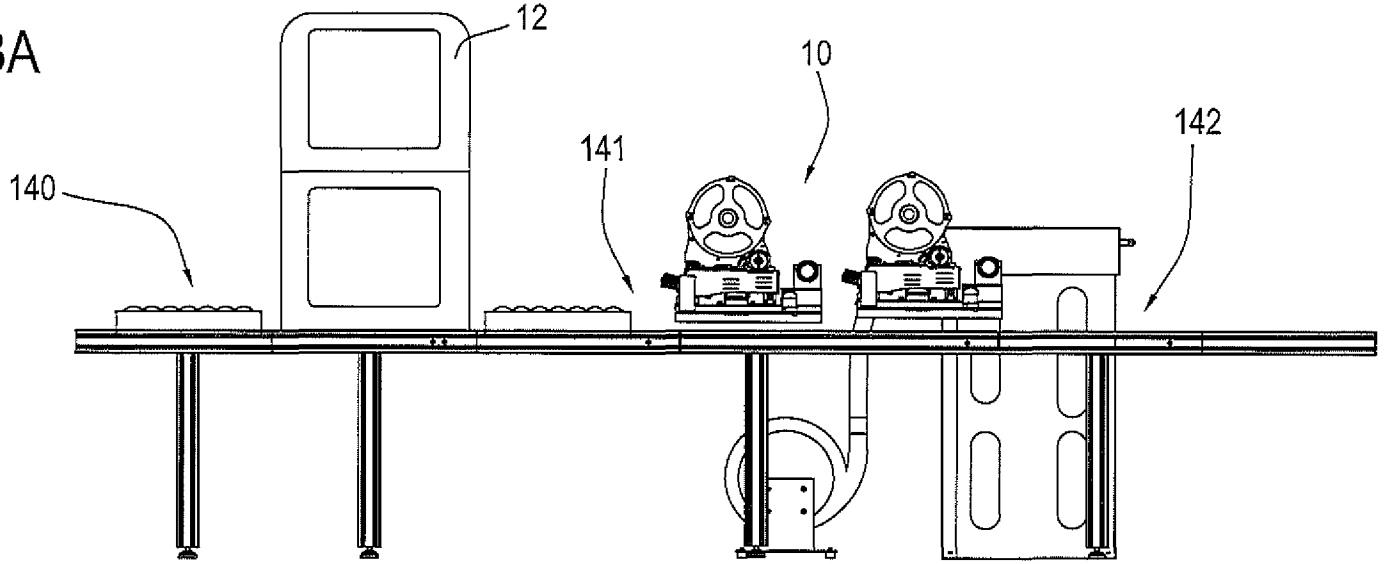
FIGS. 28A and 28B show, respectively in a side view and a top plan view, a second preferred embodiment of the apparatus according to this invention.
Figure 28B:
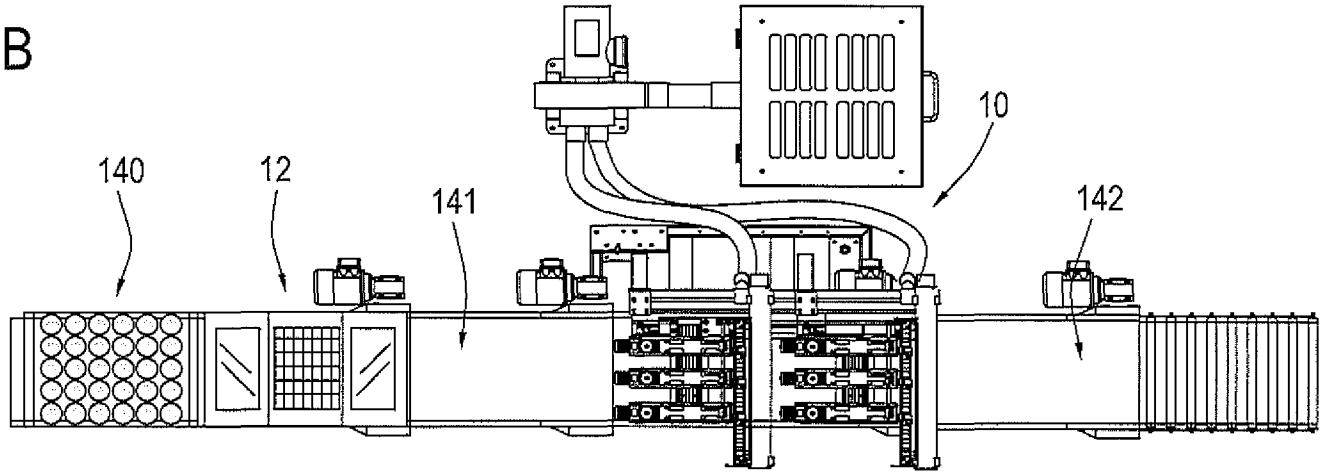

The subsequent FIGS. 28A and 28B show a further example preferred embodiment of the apparatus, or plant, for applying labels according to this invention.

In particular, this second preferred embodiment of the apparatus, or plant, comprises a product detection unit 12 upstream of which there is a suitable belt 140, forming a temporary storage belt, or means, for the product at the infeed of the detection unit 12.

Moreover, this preferred embodiment of a plant also comprises, downstream of said product detection unit 12, a further motor-driven belt 141 forming a temporary storage belt, or means, for the product at the infeed of the respective unit 10 for applying labels on respective products, and downstream of this a subsequent temporary storage belt, or means, 142, also individually motor-driven, and if necessary acting as a temporary storage plant for a subsequent unit 10 for applying labels on respective products, not illustrated in FIGS. 28A and 28B.

In use, temporary storage means are provided for the product at the infeed of the respective unit 10 for applying labels on respective products. Said temporary storage means are provided upstream of the respective unit 10 for applying labels on respective products and in particular are designed to temporarily store a respective crate, or batch of products.

In this way, it is possible to make the work of labelling and detecting the product substantially continuous.

In use, while the respective unit 10 and 12 processes respective batch of products, positioned on the respective storage belts, or means, upstream there is a corresponding batch of products to be fed continuously to the downstream operating unit, once the latter has processed a previous batch of products.

This system for detecting the batch, or crate, of products provides, amongst other things, the following parameters:

- the height of the container or crate holding the products or the batch of products configured according to a respective recipe;
- the "X" dimension, that is to say, the distance transversal to the direction of feed, starting from the reference point or "0", of each row of products or fruits;
- the "Y" dimension, that is to say, the longitudinal distance between the infeed face or front surface of the container or crate, and the first product or fruit of each row,
- the number of products or fruits present in each row; and
- the step between the products or fruits of the respective row, that is to say, the distance between each product, or fruit, and the next for each row of products.

However, it shall be understood that, in this apparatus, it is also possible to set the distance between one fruit and the next, in the same row, in such a way that it is a preset and constant value, or fixed for each pair of adjacent products in the same row.

Figure 29:
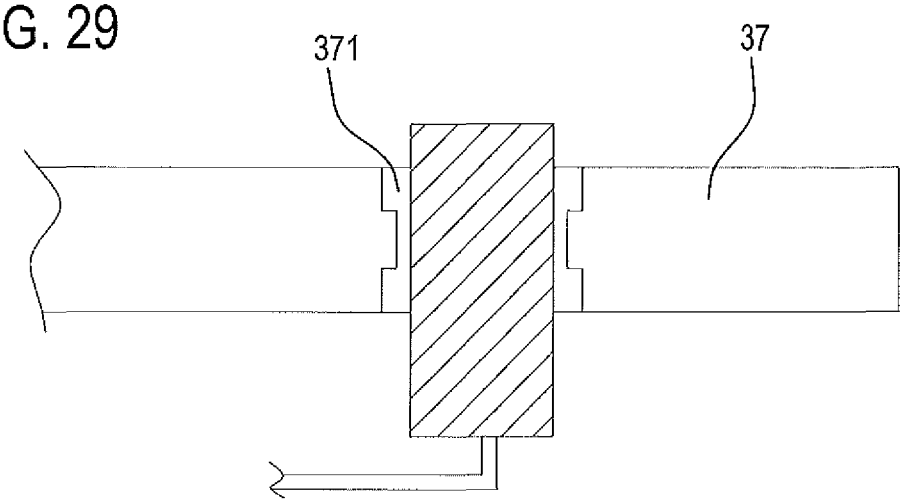
FIG. 29 is a cross-section similar to that of FIG. 13B and illustrating a second preferred embodiment of corresponding sensor means.

FIG. 29 shows a second preferred embodiment of sensor means 136, for detecting the distance between consecutive labels 3, 3 of the label carrying web 5, in particular close to the point of transfer of the labels to the pickup and application means.

Said sensor 136 is, in particular, in the form of a respective optical sensor 136, preferably in the form of an optical fibre sensor, which is positioned precisely in the same position in which the above-mentioned mechanical sensor 36 is located, that is to say, in a corresponding hole 371 made in the upper plate 37 of the supporting means 32 of the carrousel 33, or label pickup and application means.

Figure 30B:
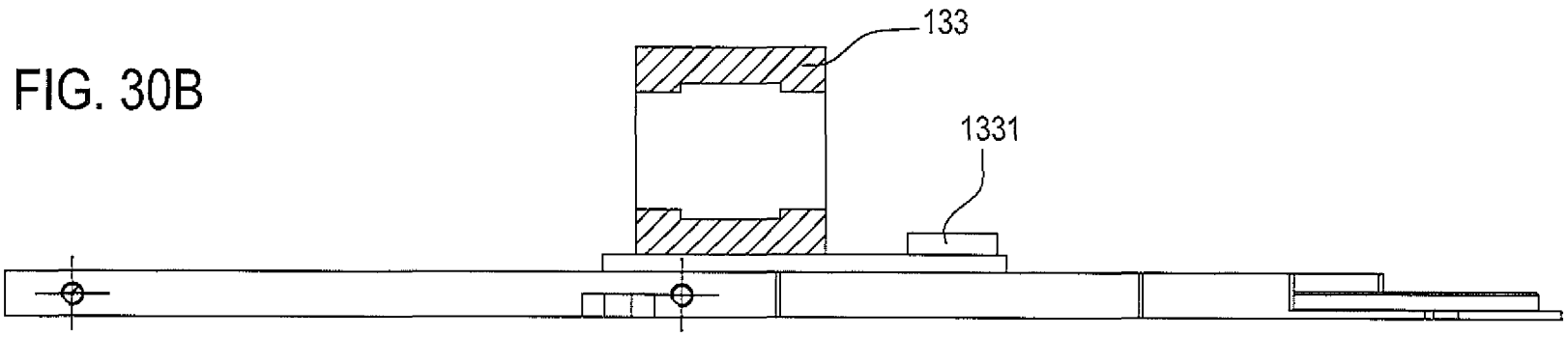
FIGS. 30A and 30B show, respectively in a side view and a top plan view, respectively the supporting base of the label application means and the side plate of the supporting base, of a second preferred embodiment of said base.
Figure 30A:
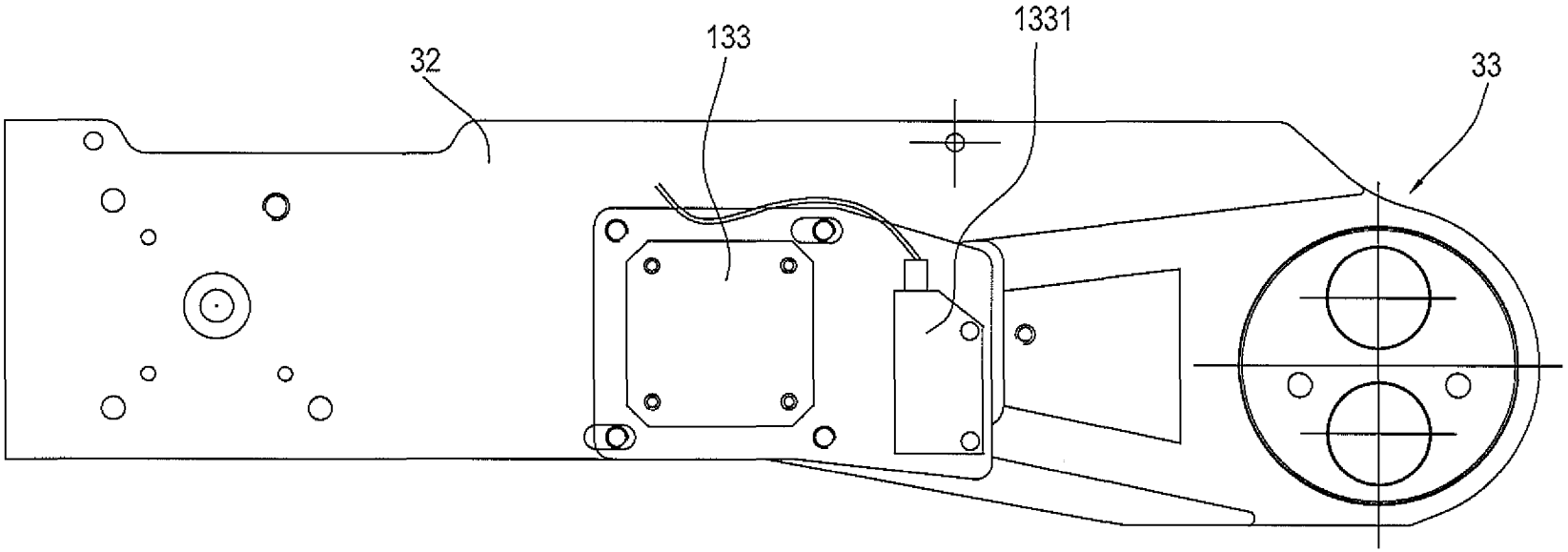

The subsequent FIGS. 30A and 308 show a second preferred embodiment of the supporting base 32 of respective label pickup and application means. In this second preferred embodiment too, the label pickup and application means are in the form of a respective carrousel 33 with corresponding radial bellows means, like those of the previous first preferred embodiment. However, they are not shown in detail in this second preferred embodiment.

Advantageously, this second preferred embodiment of the label pickup and application means comprises a stepping motor 133 which using a respective belt drives the rotation of the rotary carrousel 33 of the label pickup and application means, and corresponding sensor means, in particular in the form of a respective photocell 1331, the sensor means being designed to detect the presence of labels on the web being unwound.

In particular, when the sensor means 1331 detect the absence of labels, they send a corresponding signal which commands interruption of the rotation of the stepping motor 133.

Advantageously, to determine the end of the label carrying material or web, the control system generates a label carrying web maximum unwinding alarm signal, when the label carrying web predetermined maximum unwinding value is reached, corresponding to the situation in which the stepping motor has performed an additional rotation compared with the preset number of rotations and corresponding to the maximum length of the respective label carrying web.

Therefore, if no more labels are detected by the sensor 1331 and the apparatus processing means, or system, have already reached the label carrying web maximum unwinding condition, the apparatus processing means determine that label carrying web unwinding has effectively finished and command interruption of the label application operations, in particular interrupting, or stopping, operation (rotation) of the corresponding shaft of the motor 133 which drives the rotary carrousel 33. Vice versa, to allow the start up of the motor 133 which drives the rotary carrousel 33 of the label pickup and application means, there are means for detecting the presence of the support of the label carrying web reel, or dispenser, 31 on the supporting base 32 of the respective label pickup and application means. Said means for detecting the presence of the support of the label carrying web reel, or dispenser, 31 are advantageously formed by an electrical contact at one or both of the coupling pins 381, 381 between the support of the label carrying web reel, or dispenser, 31 and the corresponding base 32, which supports the label pickup and application means.

As shown in the subsequent FIG. 31, advantageously, the apparatus processing means, or system, can also be provided with a screen page 200 for viewing and selecting a pre-selected or preset set of recipes of batches, or crates, of products to be labelled.

In use, and preferably, said set of pre-selected recipes displayed in said screen page 200 advantageously comprises those recipes most frequently used.

As shown in this case, there are 15 pre-selected recipes which can be viewed collectively and selected through a single screen page 200.

In this way, when the number of recipes of batches, or crates, of products is very high, it is possible to avoid having to go through the whole recipe archive each time a particular recipe needs selecting.

In use, advantageously, the screen page 200 therefore comprises respective windows 201, indicating or identifying with a code or other element the corresponding search, and a corresponding active window, or box, forming a corresponding key, 202 for activating the selection of the corresponding recipe shown in the window 201.

As shown, advantageously, the active selection window 202 is at, in particular immediately below the corresponding identification window of the respective recipe 201.

A further window 203 is also used, for a corresponding progressive number identifying the number of the respective recipe in the pre-selected set of recipes of batches, or crates, of products. As illustrated, the window for identifying the progressive number of the recipe 203 of the set of pre-selected recipes is positioned at the side of the active selection window 202 and below the specific recipe identification window 201.

Such a screen page 100 provides an advantage in terms of operating times and is easy to use for the apparatus user, or manager.

Obviously, it shall be understood that this processing system comprises customization of the set of pre-selected recipes and its modification with elimination of recipe constraints and the introduction of further recipes. Obviously, the recipes eliminated from the pre-selected recipes screen page remain in the recipes general archive of the processing system of this apparatus.

The invention described above is susceptible of industrial application. It would be obvious to one skilled in the art that several changes and modifications can be made to the invention without departing from the spirit and scope of the invention, described in depth above, in particular, one skilled in the art could easily imagine further embodiments of the invention comprising one or more of the features described herein. It will also be understood that all the details of the invention may be substituted by technically equivalent elements.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An apparatus for processing respective products comprising fruit or vegetables, the products being grouped in corresponding batches, each of the batches being contained in a container or a crate, the apparatus comprising:

an applicator comprising a plurality of application devices configured to apply one or more labels on the products;

a feeder adapted for the products and configured to support the products;

an electronic processor configured to control at least the application devices; and a detector, configured to detect the products and to send corresponding data to the electronic processor, the data comprising a plurality of points of respective plane coordinates, the respective plane coordinates comprising a transversal coordinate and a longitudinal coordinate relative to a direction of feed and a respective height or perpendicular coordinate relative to a batch lying plane, wherein the application devices are arranged in a first transversal row and a second transversal row, wherein each of the first transversal row and the second transversal row includes one or more of the application devices, the application devices being transversally moveable, wherein the application devices of the first transversal row operate on respective rows of products, which alternate with rows of the products that are processed by the application devices of the second transversal row, wherein the electronic processor is configured to determine a configuration of the products based on the data sent by the detector, the configuration comprising a position and a shape of each of the products, wherein, for each product of the products, the electronic processor is configured to determine, based on the detected configuration of the products, a product area, which has a circular or oval shape and which is large enough to allow complete application of a corresponding label of the labels on the product as a label application area, wherein, for the label application area of each of the products, the electronic processor is configured to determine a reference point, the reference point comprising a central point of the product area and having respective transversal and longitudinal coordinates, wherein the electronic processor is configured to determine for each of respective longitudinal rows of the products, a transversal operating positing of a respective one of the application devices, the transversal operating position of the respective one of the application devices being based on the respective transversal coordinate of the reference point of the each of the products of the respective one of the longitudinal rows of the products, wherein the electronic processor is configured to position the respective one of the application devices at the respective transversal operating position, and wherein the detector is configured to determine:

a height of the container or crate of each of the batches, a distance transversal to the direction of the feed, starting from a row reference point of each of the rows of products, a longitudinal distance between an infeed face or front surface of the container or crate and a first product of each of the rows of products, a number of products present in each of the rows of the products, and a distance between each of the products in each of the rows of the products.

2. The apparatus of claim 1, wherein the transversal operating position of the application devices is determined with reference to a batch starting point, corresponding to a corresponding edge of the container or the crate for one of the batches.

3. The apparatus of claim 1, wherein the detector is a laser profilometer.

4. The apparatus of claim 1, wherein the applicator comprises:

a pick-up unit, which is configured to pick up and apply at least some of the labels, the pickup unit comprising:

bellows, each of the bellows being mobile between a retracted position for picking up the respective one of the labels and an extended position for applying the respective one of the labels on the product of the products; and a rotary carrousel, in a vertical plane, longitudinal to the direction of feed, the rotary carrousel supporting the bellows, wherein a rotation speed of the rotary carrousel determines a longitudinal label applying process, wherein the application devices each comprise a label feeder configured to feed corresponding ones of the labels towards a point of label delivery to the pick-up unit, wherein the label feeder comprises a support for a reel of a label carrying web that comprises at least some of the labels, and wherein the label carrying web is separable into a first half-web and a second half-web downstream of the point of label delivery.

5. The apparatus of claim 1, further comprising:

a mechanical or optical sensor, which is configured to detect a distance separating one label of the labels and a subsequent label of the labels on a label carrying web as the one label and the subsequent label advance towards a label delivery point.

6. The apparatus of claim 1, further comprising:

a label carrying web drawer, which comprises a free wheel device that engages with and pulls a web comprising at least some of the labels.

7. The apparatus of claim 1, wherein a frame of a pick-up unit supports one or more of: end-of-paper sensors and/or space sensors for detecting a space between the labels, and/or a bellows sensor, and/or a web motor for rotation of a label web feeder, and/or a rotation motor for rotation of an application device transversal displacer.

8. The apparatus of claim 1, further comprising:

a stepping motor, which operates a rotary carrousel or pick-up unit configured to pick up and apply the labels; and a label detection sensor configured to detect whether the labels are present on a label carrying web being unwound, such that, when the label detection sensor detects an absence of the labels, the sensor sends a corresponding signal commanding interruption of the stepping motor's rotation.

* * * * *